US007806036B2

(12) United States Patent
Cook et al.

(10) Patent No.: US 7,806,036 B2
(45) Date of Patent: Oct. 5, 2010

(54) MAGAZINE APPARATUSES, FIREARMS INCLUDING SAME, AND METHOD OF INTRODUCING AN AMMUNITION CARTRIDGE INTO A FIREARM

(75) Inventors: Ryan D. Cook, Morgan, UT (US); Dwight M. Potter, Liberty, UT (US)

(73) Assignee: Browning, Morgan, UT (US)

( * ) Notice: Subject to any disclaimer, the term of this patent is extended or adjusted under 35 U.S.C. 154(b) by 968 days.

(21) Appl. No.: 11/324,574

(22) Filed: Jan. 3, 2006

(65) Prior Publication Data

US 2007/0151440 A1 Jul. 5, 2007

(51) Int. Cl.
*F41A 9/00* (2006.01)

(52) U.S. Cl. ..... 89/33.02; 42/17; 42/18; 42/6; 42/49.01; 42/50; 89/33.1

(58) Field of Classification Search ..... 89/33.02, 89/33.1, 33.01, 33.16, 33.17; 42/17, 18, 42/6, 49.01, 50
See application file for complete search history.

(56) References Cited

U.S. PATENT DOCUMENTS

| | | | | |
|---|---|---|---|---|
| 1,008,162 | A | 11/1911 | Krnka | |
| 1,042,837 | A | 10/1912 | Tatarek | |
| 1,281,497 | A | 10/1918 | Bräuning | |
| 1,306,972 | A | 6/1919 | Nelson | |
| 1,314,013 | A * | 8/1919 | Mulvey | 42/19 |
| 1,833,431 | A | 11/1931 | McCormick | |
| 2,007,774 | A | 7/1935 | Sedgley et al. | |
| 2,064,888 | A | 12/1936 | Dickinson | |
| 2,066,361 | A | 1/1937 | Nomar | |
| 2,114,311 | A | 4/1938 | Normar | |
| 2,130,722 | A | 9/1938 | Kobe | |
| 2,131,412 | A | 9/1938 | Ostman | |
| 2,321,720 | A | 5/1941 | Whittaker | |
| 2,311,497 | A | 2/1943 | Van Horn et al. | |
| 2,338,984 | A | 1/1944 | Van Horn et al. | |
| 2,367,572 | A | 1/1945 | Gazda | |
| 2,394,606 | A | 2/1946 | Gazda | |
| 3,239,959 | A | 3/1966 | Sefried, II et al. | |
| 3,373,521 | A | 3/1968 | Into | |
| 3,390,475 | A | 7/1968 | Badali et al. | |
| 3,562,944 | A | 2/1971 | Wagner et al. | |
| 3,720,301 | A * | 3/1973 | Garland et al. | 198/418.2 |
| 3,745,687 | A | 7/1973 | Koon, Jr. | |
| 4,027,415 | A | 6/1977 | Stoner | |
| 4,332,097 | A * | 6/1982 | Taylor, Jr. | 42/50 |

(Continued)

*Primary Examiner*—Michelle Clement
(74) *Attorney, Agent, or Firm*—Holland & Hart

(57) ABSTRACT

A magazine for introducing a plurality of ammunition cartridges into a firearm is disclosed. Particularly, a magazine may include a first rotor configured for rotating about a first center of rotation and a second rotor configured for rotating about a second center of rotation, wherein a position of the first rotor and a position of the second rotor are fixed with respect to one another. Further, operation of the first and second rotor may cause at least one ammunition cartridge of a plurality of ammunition cartridges that are movable by the first and second rotor to move along a serpentine path. Firearm systems including such a magazine are also disclosed. Another aspect of the present invention relates to a method of introducing an ammunition cartridge into a firearm. More specifically, an ammunition cartridge may be moved along a selected serpentine path prior to introducing the ammunition cartridge into a firearm.

53 Claims, 16 Drawing Sheets

U.S. PATENT DOCUMENTS

| | | | | | |
|---|---|---|---|---|---|
| 4,366,638 | A | | 1/1983 | Ketterer et al. | |
| 4,384,508 | A | | 5/1983 | Sullivan et al. | |
| 4,413,546 | A | | 11/1983 | Taylor, Jr. | |
| 4,445,418 | A | * | 5/1984 | Sullivan et al. | 89/33.02 |
| 4,471,549 | A | | 9/1984 | Brint et al. | |
| 4,487,103 | A | | 12/1984 | Atchisson | |
| 4,503,750 | A | * | 3/1985 | Ignacek | 89/34 |
| 4,524,672 | A | | 6/1985 | Balsavage | |
| 4,524,673 | A | | 6/1985 | Golden | |
| 4,573,395 | A | * | 3/1986 | Stoner | 89/33.16 |
| H164 | H | | 11/1986 | Savioli | |
| 4,658,700 | A | | 4/1987 | Sullivan | |
| 4,658,701 | A | * | 4/1987 | Moore | 89/33.2 |
| 4,676,137 | A | | 6/1987 | Stockton et al. | |
| 4,676,138 | A | * | 6/1987 | Thompson et al. | 89/33.14 |
| 4,681,018 | A | * | 7/1987 | Beckmann | 89/33.04 |
| 4,689,907 | A | | 9/1987 | Gwinn, Jr. | |
| 4,744,164 | A | | 5/1988 | Rieger | |
| 4,745,842 | A | * | 5/1988 | Shou-Fu | 89/33.02 |
| 4,765,223 | A | * | 8/1988 | Beckmann | 89/33.04 |
| 4,766,800 | A | | 8/1988 | Miller et al. | |
| D297,661 | S | | 9/1988 | Gwinn, Jr. | |
| 4,811,510 | A | | 3/1989 | Chesnut | |
| 4,833,966 | A | * | 5/1989 | Maher et al. | 89/33.16 |
| 4,881,447 | A | * | 11/1989 | Yanusko et al. | 89/34 |
| 4,888,898 | A | | 12/1989 | Miller et al. | |
| 4,926,742 | A | * | 5/1990 | Ma et al. | 89/33.02 |
| 4,965,951 | A | | 10/1990 | Miller et al. | |
| 4,970,820 | A | | 11/1990 | Miller et al. | |
| 5,109,751 | A | * | 5/1992 | Hagen et al. | 89/33.16 |
| 5,147,972 | A | * | 9/1992 | Hagen et al. | 89/33.16 |
| 5,149,909 | A | * | 9/1992 | Hagen et al. | 89/33.16 |
| 5,271,310 | A | * | 12/1993 | Muller | 89/33.04 |
| 5,398,590 | A | * | 3/1995 | Snyder, Sr. | 89/33.16 |
| 5,440,964 | A | * | 8/1995 | Bender-Zanoni | 89/34 |
| 5,533,291 | A | | 7/1996 | Boland | |
| 5,561,258 | A | | 10/1996 | Bentley et al. | |
| 5,594,192 | A | * | 1/1997 | Rodriguez | 89/33.16 |
| 5,600,083 | A | | 2/1997 | Bentley et al. | |
| 5,614,689 | A | * | 3/1997 | Gyre et al. | 89/33.04 |
| 5,628,137 | A | | 5/1997 | Cortese | |
| 5,771,620 | A | | 6/1998 | Crawford et al. | |
| 5,816,444 | A | | 10/1998 | David | |
| 6,073,534 | A | * | 6/2000 | Gagnon | 89/45 |
| 6,109,252 | A | | 8/2000 | Stevens | |
| 6,272,967 | B1 | * | 8/2001 | Bender-Zanoni et al. | 89/33.04 |
| 6,327,953 | B1 | | 12/2001 | Andresen | |
| 6,367,188 | B1 | | 4/2002 | Vargas | |
| 6,502,495 | B1 | | 1/2003 | Beary | |
| 6,601,496 | B1 | | 8/2003 | Kalashnikov et al. | |
| 6,837,844 | B1 | | 1/2005 | Ellard et al. | |
| 2006/0283431 | A1 | | 12/2006 | Lee et al. | |
| 2007/0107592 | A1 | * | 5/2007 | Snow | 89/33.02 |
| 2007/0151440 | A1 | * | 7/2007 | Cook et al. | 89/33.17 |

* cited by examiner

MAGAZINE APPARATUSES, FIREARMS INCLUDING SAME, AND METHOD OF INTRODUCING AN AMMUNITION CARTRIDGE INTO A FIREARM

BACKGROUND OF THE INVENTION

A magazine, when used association with a firearm, refers to an apparatus that holds ammunition cartridges and feeds them, one by one, automatically into the chamber of the firearm (e.g., a semi-automatic pistol or rifle). Often a magazine may be easily removable from the firearm for reloading and may insert into the grip of a pistol or adjacent to the firing mechanism of a rifle. Semiautomatic and fully automatic firearms such as pistols and submachine guns typically utilize a conventional magazine employing a columnar feeding arrangement to store and supply cartridges to the action of the firearm. Typically, a receptacle or cavity formed in the firearm (e.g., a pistol grip) is configured to receive such a conventional magazine. However, as known in the art, other conventional magazines store ammunition cartridges arranged in two staggered columns (i.e., one above the other) or in a double-column arrangement.

For convenience, a gun user may want to be able to shoot as many ammunition rounds or cartridges as possible before replacing or reloading an empty magazine. Therefore, a gun user may generally prefer a magazine that will hold a greater number of ammunition cartridges. Further, a combat shooter may have an imperative need to increase the number of rounds that can be fired without reloading. A conventional linear or columnar magazine, however, has certain inherent limitations as to the number of ammunition cartridges that can be stored and dependably fed to firearm and such conventional magazines may also be limited relative to their overall size and shape. In addition, conventional, so-called "drum magazines" are known in the art. One example of a conventional drum magazine is disclosed in U.S. Pat. No. 2,131,412 to Ostman. Such conventional drum magazines may also be limited relative to their overall size, shape, and configuration.

Accordingly, it would be advantageous to provide methods, apparatuses, and systems for feeding ammunition cartridges into a firearm which provide advantages over the conventional methods, apparatuses, and systems.

SUMMARY OF THE INVENTION

One aspect of the present invention relates to a magazine for introducing a plurality of ammunition cartridges into a firearm. Particularly, such a magazine may include a first rotor configured for rotating about a first center of rotation and a second rotor configured for rotating about a second center of rotation. Also, a position of the first rotor and a position of the second rotor may be fixed with respect to one another. Further, operation of the first and second rotor may cause at least one ammunition cartridge of a plurality of ammunition cartridges that are movable by the first and second rotor to move along a serpentine path. Firearm systems including such a magazine are also contemplated by the present invention.

Another aspect of the present invention relates to a method of introducing an ammunition cartridge into a firearm. More specifically, an ammunition cartridge may be moved along a selected serpentine path prior to introducing the ammunition cartridge into a firearm. Such a configuration may provide a relatively compact, flexible, and efficient method for introducing an ammunition cartridge into a firearm.

Features from any of the above-mentioned embodiments may be used in combination with one another in accordance with the present invention. In addition, other features and advantages of the present invention will become apparent to those of ordinary skill in the art through consideration of the ensuing description, the accompanying drawings, and the appended claims.

BRIEF DESCRIPTION OF THE DRAWINGS

Advantages of the present invention will become apparent upon review of the following detailed description and drawings, which illustrate representations (not necessarily drawn to scale) of various embodiments of the invention, wherein.

DETAILED DESCRIPTION OF THE INVENTION

Generally, the present invention relates to apparatuses and methods for feeding or introducing an ammunition cartridge into a firearm. "Firearm," as used herein, means any apparatus configured to expel a projectile through a barrel. For example, the term "firearm" encompasses a weapon from which at least one projectile is expelled by gunpowder, such as a rifle, a pistol, a shotgun, etc. In addition, the term "firearm" also encompasses any type of "gun" for expelling a projectile such as a paint-ball gun, a pellet gun (e.g., powered by compressed gas), a BB gun, etc. Correspondingly, "ammunition cartridge," as used herein, means any projectile (optionally including its propelling charge, if any) for use with a suitable firearm. Thus, one aspect of the present invention contemplates that at least one ammunition cartridge may be introduced into a firearm along a serpentine path. "Serpentine," as used herein, means a compound curve including a first curve (e.g., a generally spiral, a generally circular arc, a generally elliptical arc, a generally parabolic curve, a generally hyperbolic curve, an algebraic curve, a plane curve, or any other curve as known in the art) and at least a second curve.

Figure 1:
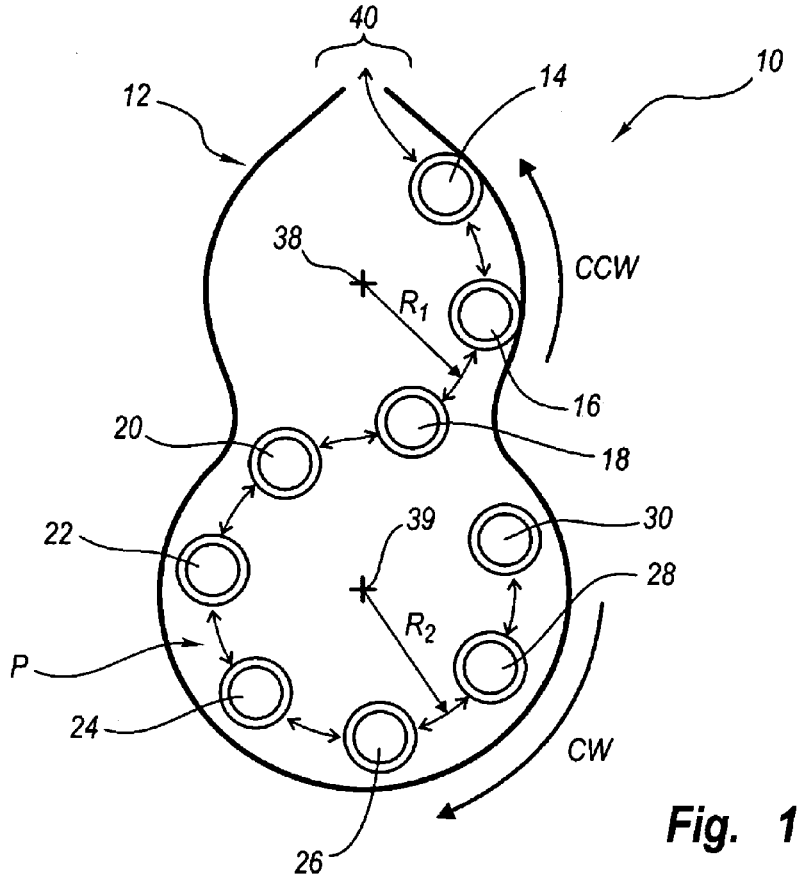
FIG. 1 shows a schematic representation of a serpentine path along which ammunition cartridges may be moved.

One aspect of the present invention relates to a method of the introducing an ammunition cartridge into a firearm. More specifically, the present invention contemplates that an ammunition cartridge may be moved generally along a serpentine path. In one embodiment, a serpentine path may include a first generally circular arc formed about a first center of rotation and a second generally circular arc formed about another center of rotation. For example, FIG. 1 shows a schematic representation of a plurality of ammunition cartridges 14, 16, 18, 20, 22, 24, 26, 28, and 30 that may be sequentially positioned generally within ammunition cartridge feeding opening 40. More specifically, boundary 12 may also define an ammunition cartridge feeding opening 40 through which ammunition cartridges 14, 16, 18, 20, 22, 24, 26, 28, and 30 may be introduced within or expelled from an interior of boundary 12. As shown in FIG. 1, path P (referred to herein as "cartridge path P" or "serpentine path P") extends generally between ammunition cartridge feeding opening 40 and ammunition cartridge 30 and defines a path along which ammunition cartridges 14, 16, 18, 20, 22, 24, 26, 28, and 30 may be moved. The entire path P shown in FIGS. 1-5 is generally serpentine in shape defining a serpentine path. In further detail, as shown in FIG. 1, a portion of serpentine path P follows a generally circular arc having a center of rotation 38 and a radius $R_1$. In addition, as shown in FIG. 1, a portion of serpentine path P follows another generally circular are having a center of rotation 39 and a radius $R_2$. Center of rotation 38 and center of rotation 39 may be positioned in a fixed relationship with one another. Thus, serpentine path P may exhibit a selected shape and size that does not vary (i.e., is unchangeable) during movement of the ammunition cartridges 14, 16, 18, 20, 22, 24, 26, 28, and 30. As shown in FIG. 1, a first curve of serpentine path P extends generally from ammunition cartridge feeding opening 40. Optionally, a boundary (e.g., a housing) may be positioned to facilitate movement of ammunition cartridges 14, 16, 18, 20, 22, 24, 26, 28, and 30 along at least a portion of serpentine path P. It may be further appreciated that the movement of ammunition cartridges 14, 16, and 18 toward ammunition cartridge feeding opening 40 may be described as a counter-clockwise rotation (i.e., a direction labeled CCW in FIG. 1) about center of rotation 38. Likewise, the movement of ammunition cartridges 20, 22, 24, 26, 28, and 30 toward ammunition cartridge feeding opening 40 may be generally described as a clockwise rotation (i.e., a direction labeled CW in FIG. 1) about center of rotation 39.

Figure 2:
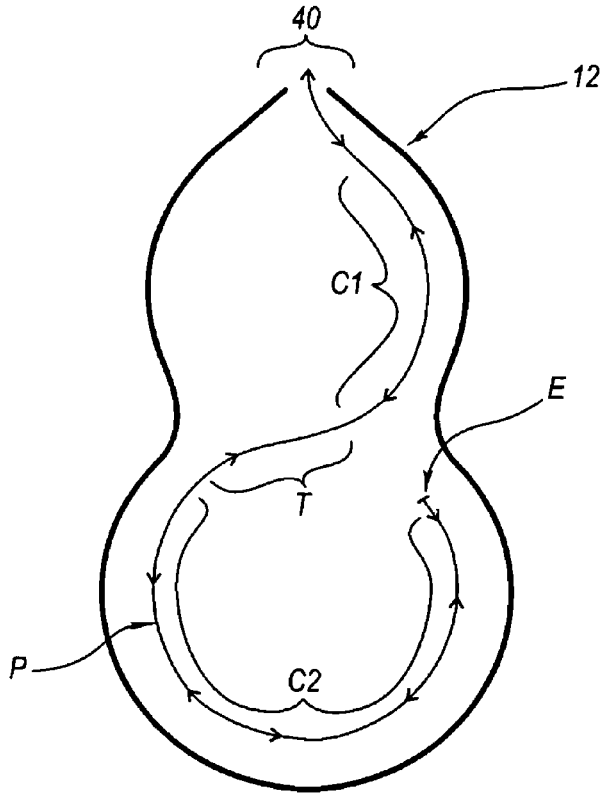
FIG. 2 shows a schematic representation of the serpentine path shown in FIG. 1.

Put another way, in one embodiment, a serpentine path may include at least two arcuate portions or regions (e.g., curves) connected to one another by a transition region. FIG. 2 shows a schematic representation of serpentine path P extending between ammunition cartridge feeding opening 40 and point E and including arcuate region $C_1$, arcuate region $C_2$, and transition region T. More generally, serpentine path P may include at least two arcuate regions (e.g., $C_1$ and $C_2$). Optionally, serpentine path P may include at least one linear region (e.g., transition region T) or another region in which the ammunition cartridges are rotated, twisted, or otherwise moved. Accordingly, the present invention contemplates that a serpentine path may exhibit a variety of different embodiments. As may be appreciated, feeding ammunition cartridges along a serpentine path may provide a relative amount of flexibility in the overall size and shape of a container (e.g., a magazine) for containing the ammunition cartridges.

Figure 3:
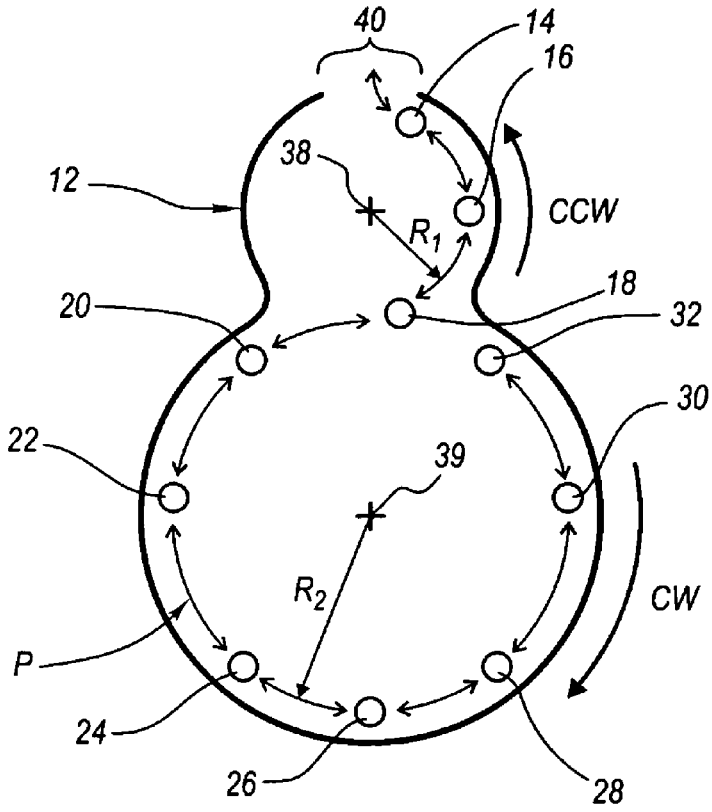
FIG. 3 shows a schematic representation of one embodiment of a serpentine path along which ammunition cartridges may be moved including curves of different sizes.
Figure 4:
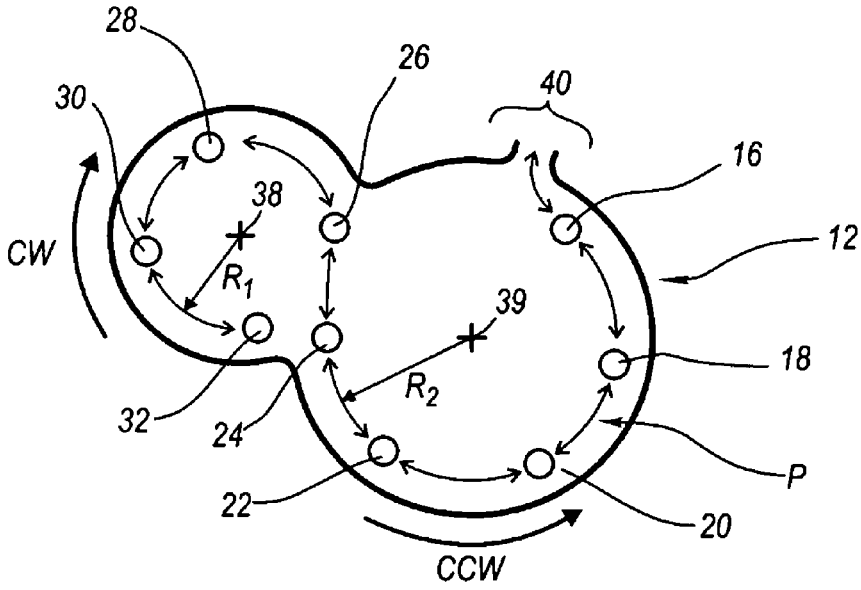
FIG. 4 shows a schematic representation of another embodiment of a serpentine path along which ammunition cartridges may be moved including curves of different sizes.

For example, in one embodiment, the at least two arcuate regions may be sized differently. In one particular embodiment, FIG. 3 shows a serpentine path including a generally circular arc with a radius $R_1$ that is smaller than a radius $R_2$ of another generally circular arc of the serpentine path P. Also, movement of ammunition cartridges 14, 16, and 18 toward ammunition cartridge feeding opening 40 may be described as a counter-clockwise rotation (i.e., a direction labeled CCW in FIG. 3) about center of rotation 38 and movement of ammunition cartridges 20, 22, 24, 26, 28, 30 and 32 toward ammunition cartridge feeding opening 40 may be described as a clockwise rotation (i.e., a direction labeled CW in FIG. 3) about center of rotation 39. Such a configuration may be desirable for storing a selected number of ammunition cartridges of a specific size and configuration within a given amount of space. FIG. 4 shows another embodiment of a serpentine path P including two arcuate regions having different sizes. More specifically, the first generally circular arc of serpentine path P has a radius $R_1$ which is greater than a radius $R_2$ of another generally circular arc of serpentine path P. Thus, ammunition cartridges 16, 18, 20, 22, and 24 may be generally located along a first generally circular arc of serpentine path P and ammunition cartridges 26, 28, 30, and 32 may be generally located upon a second generally circular arc of serpentine path P. Such ammunition cartridges 16-32 may move toward ammunition cartridge feeding opening 40 in directions CW and CCW, as discussed above. It may also be appreciated that ammunition cartridge feeding opening 40 is not generally aligned with a line passing through center of rotation 38 and center of rotation 39, as is shown in FIGS. 1-3. Accordingly, summarizing, the present invention contemplates that two or more arcuate regions of a serpentine path may be configured, as desired, without limitation and an ammunition cartridge feeding opening 40 may be selectively positioned along or adjacent to such a serpentine path.

Figure 5:
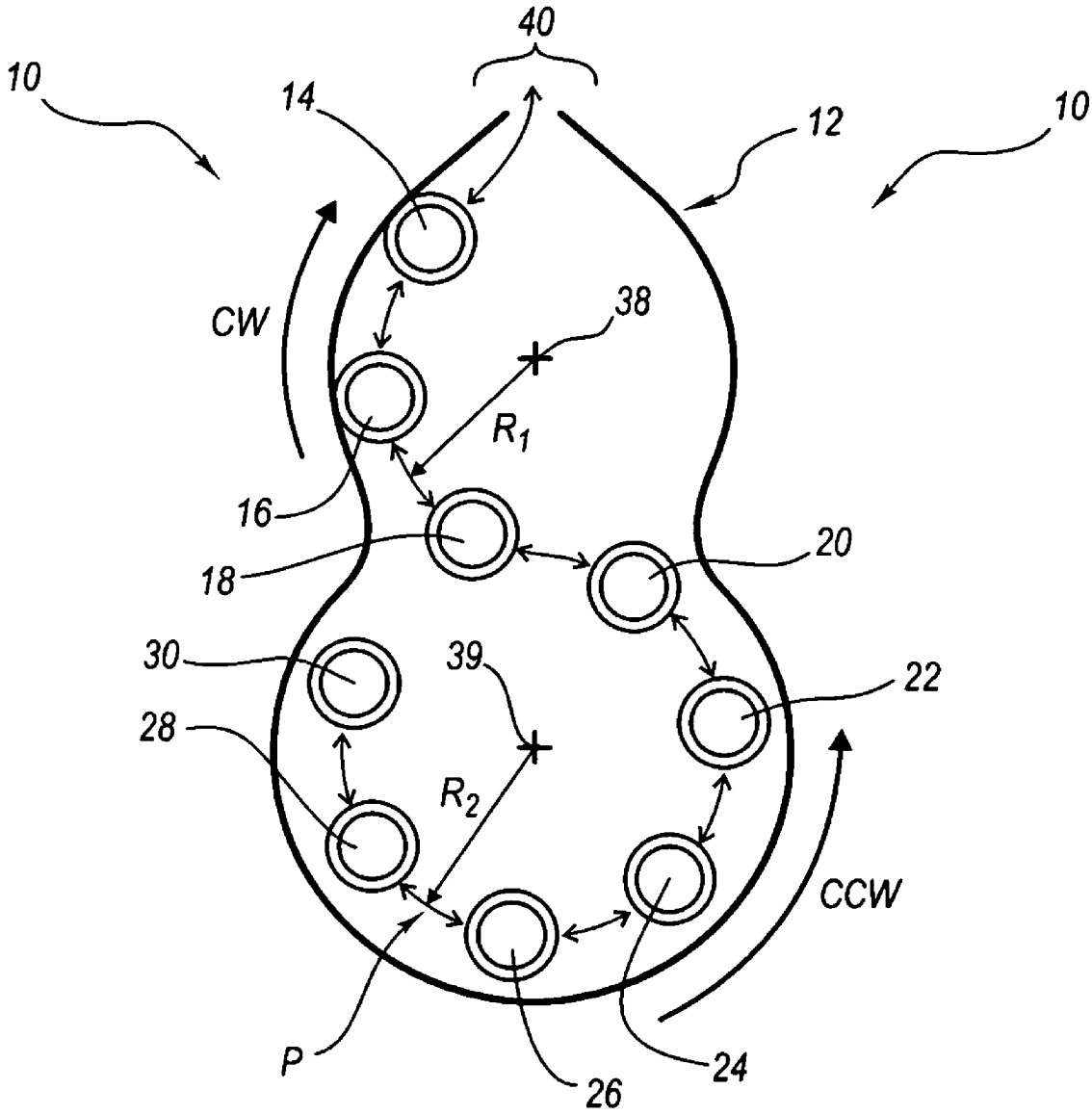
FIG. 5 shows a schematic representation of a further embodiment of a serpentine path along which ammunition cartridges may be moved.

The present invention further contemplates that the at least two curves of a serpentine path may be configured differently. For instance, such curves may comprise any of the following curves: a generally spiral, a generally circular arc, a generally elliptical arc, a generally parabolic curve, a generally hyperbolic curve, an algebraic curve, a plane curve, or any other curve as known in the art. Accordingly, the at least two curves of a serpentine path may comprise curves of different types. It should also be appreciated that the direction in which an ammunition cartridge moves along a serpentine path is dependent upon the frame of reference (i.e., the direction and position) from which it is viewed. Thus, while directions (i.e., CW and CCW) are noted in FIGS. 1-4, for clarity, these directions are not limiting. For example, FIG. 5 shows another embodiment of a serpentine path P, which is generally configured as described above in relation to FIG. 1. However, an ammunition cartridge 30, when moving toward ammunition cartridge feeding opening 40, moves counter-clockwise (labeled CCW in FIG. 5) about center of rotation 39 and subsequently moves clockwise (labeled CW in FIG. 5) about center of rotation 38. Accordingly, a serpentine path may include at least two curves along which ammunition cartridges may move and which may be configured, as desired, without limitation.

Figure 6:
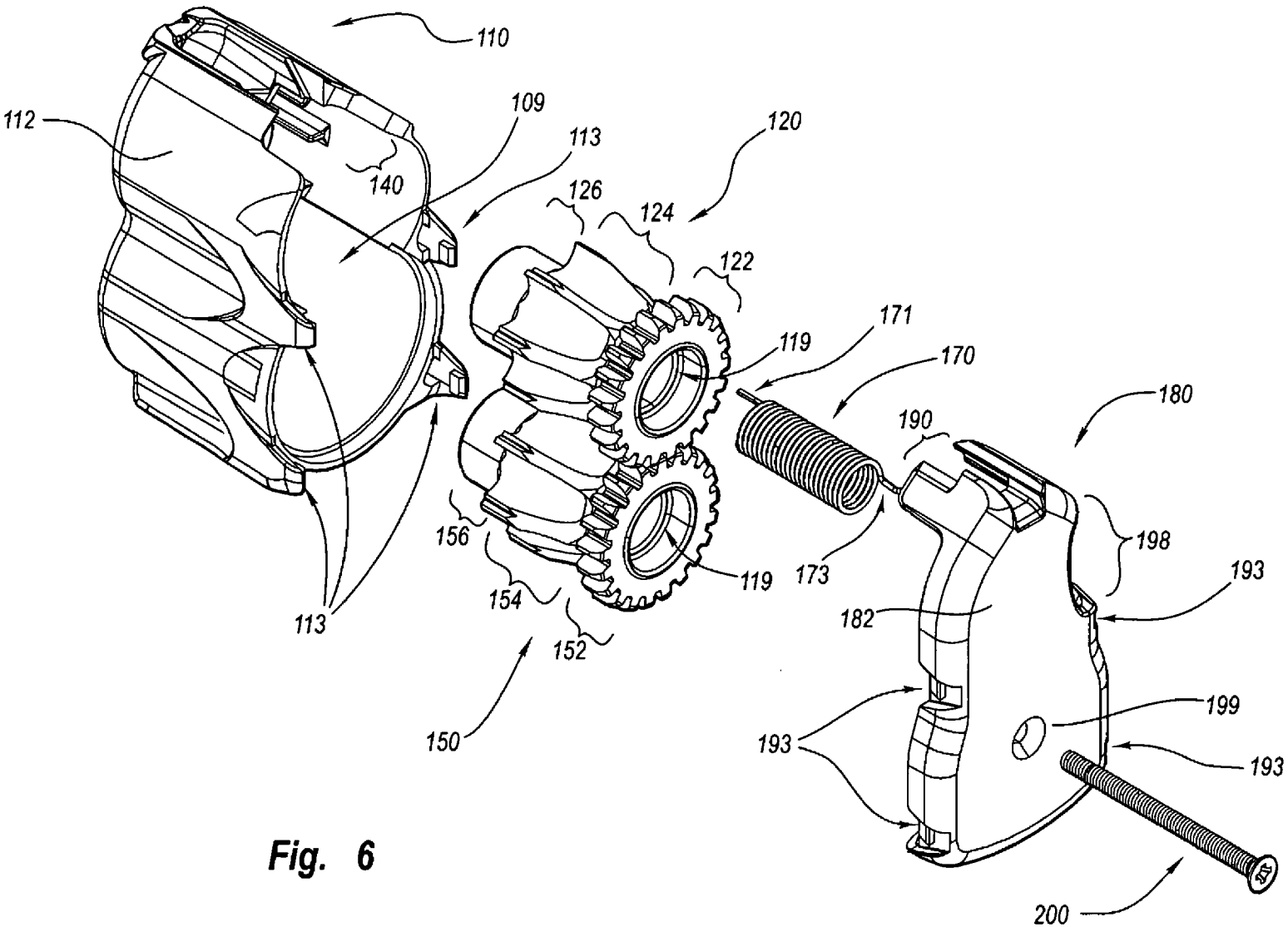
FIG. 6 shows an exploded assembly view of one embodiment of a magazine according to the present invention.

Of course, the present invention further contemplates apparatuses (i.e., magazines) for sequentially introducing a plurality of ammunition cartridges to a firearm. In one embodiment, a plurality of rotors positioned within a housing may be employed for moving at least one ammunition cartridge of a plurality of ammunition cartridges along a serpentine path. For example, FIG. 6 shows an exploded assembly view of one embodiment of a magazine according to the present invention. More specifically, FIG. 6 shows magazine 100 including a housing (i.e., the assembly of housing base 110 and housing cover 180), rotor 120, rotor 150, biasing element 170, and fastening element 200. In addition, FIG. 7 shows an exploded assembly view of magazine 100, from a different vantage point or frame of reference.

As shown in FIG. 6, housing base 110 comprises a housing body 112 which defines a cavity 109 and an opening 140. In addition, fastening features 113 extend generally from housing body 112 and are configured to couple to a recess or other coupling feature of housing cover 180. Cavity 109, as shown in FIGS. 6 and 7, is configured to accept at least a portion of rotor 120 and at least a portion of rotor 150. As discussed in greater detail below, cavity 109 of housing base 110 may be configured to facilitate movement of at least one cartridge within magazine 100 along a serpentine path. Explaining further, upon assembly of magazine 100, ammunition cartridges may be introduced generally within cavity 109 of housing base 110 through opening 140. Such ammunition cartridges may be caused to move about a center of rotation of each of rotors 120 and 150. Generally, at least one biasing element may be configured to apply a torque to at least one of rotors 120, 150 (i.e., rotor 120, rotor 15, or both rotors 120, 150). For example, biasing element 170 (e.g., at least one torsion spring or the like) may be configured to generate a torque upon at least one of rotors 120, 150 which may be used to rotate both rotor 120 and rotor 150. More specifically, rotor 120 and rotor 150 may be geared so that rotation of one or rotors 120 and 150 causes rotation of the other of rotors 120 and 150. Further, as may be appreciated, the position of each of rotor 120 and 150, in the embodiment shown in FIGS. 6 and 7, is unchanging or fixed relative to one another. Thus, rotors 120 and 150 (i.e., including each of the centers of rotation of rotors 120 and 150) are positioned in a fixed relationship with respect to one another to effect movement of at least one ammunition cartridge along a selected serpentine path. Upon assembly, as shown in FIG. 6, recess 119 of rotor 120 may accept at least a portion of biasing element 170. Also, recess 172 of rotor 150 may be configured to accepting at least a portion of fastening element 200. In one embodiment, a threaded aperture may be formed in housing base 110 and configured to accept a threaded end region of fastening element 200. In addition, as shown in FIGS. 6 and 7, housing cover 180 includes a body 182 generally defining a lid or a closure for closing the cavity 109 of housing base 110. As shown in FIGS. 6 and 7, housing cover 180 includes a gear access opening 198 configured to allow access to gear region 122 of rotor 120 and engagement features 193 configured to couple with fastening features 113 of housing base 110. Aperture 199 formed through body 182 of housing cover 180 may allow for at least a portion of fastening element 200 to pass therethrough to effectively couple housing cover 180 to housing base 110. Opening 190 of housing cover 180 may generally correspond with opening 140 of housing base 110 so that when housing cover 180 is assembled to housing base 110 openings 140 and 190, in combination with one another, form an aperture (e.g., ammunition cartridge feeding opening 40) through which ammunition cartridges may be introduced into magazine 100 or expelled therefrom. Of course, the magazine 100 shown in FIGS. 6 and 7 may be configured for a selected type of ammunition cartridge. It may also be appreciated that modification (e.g., the size of cavity 109) of one or more of the housing base 110, housing cover 180, rotors 120, 150, or combinations thereof may allow magazine 100 to accept a different size of ammunition cartridge.

Figure 8:
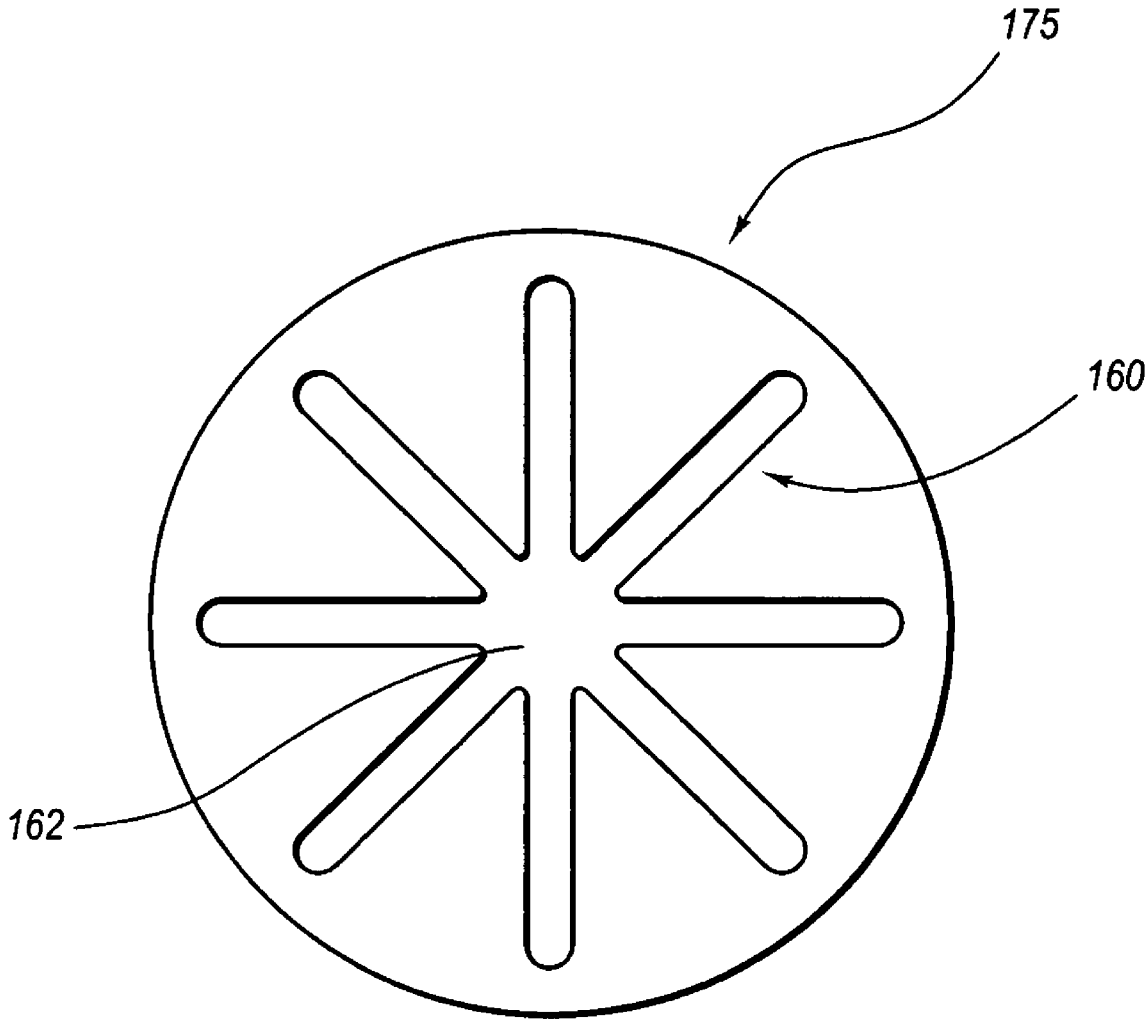
FIG. 8 shows a schematic view of an interlock feature of the rotor shown in FIGS. 6 and 7.
Figure 9:
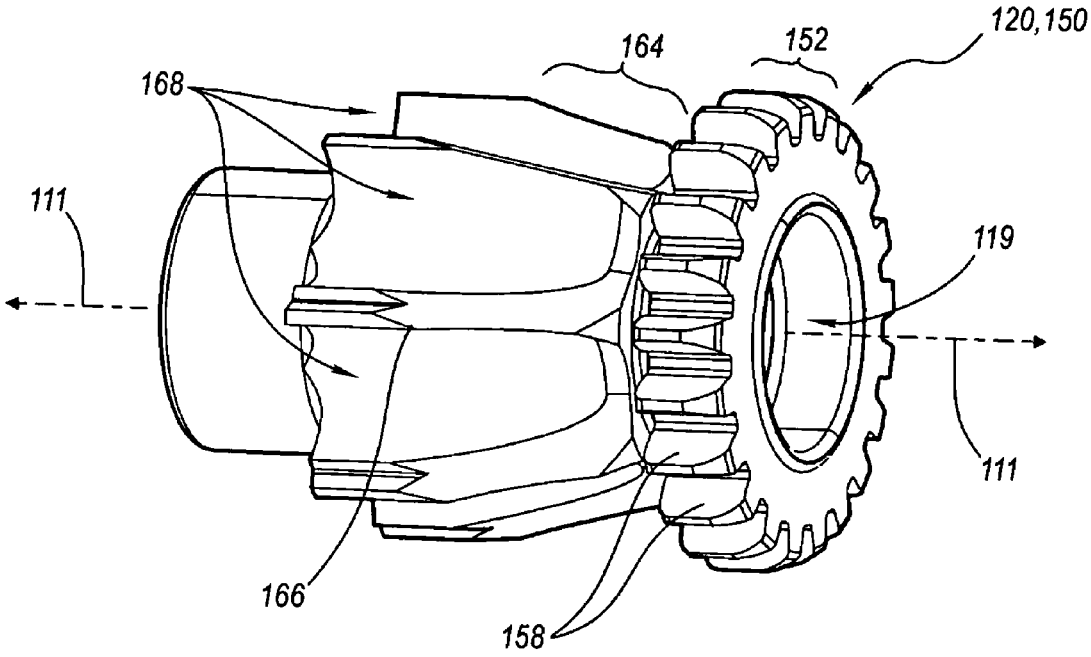
FIG. 9 shows a perspective view of the rotor shown in FIGS. 6 and 7.
Figure 10:
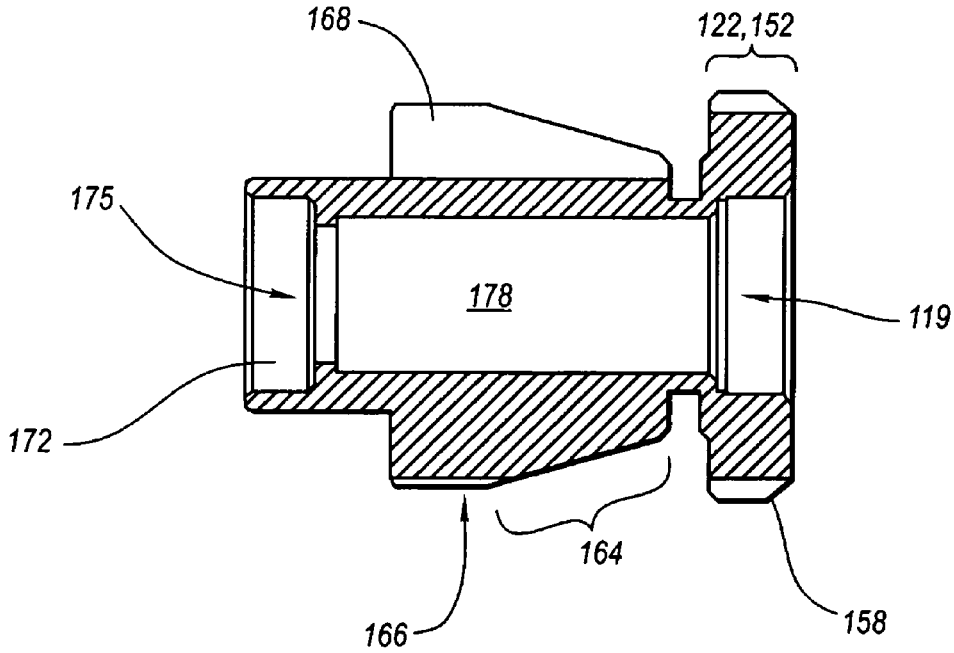
FIG. 10 shows a side cross-sectional view of the rotor shown in FIG. 9.

With respect to rotors 120, 150, each may be respectively formed by any suitable processes known in the art, for example, injection molding, machining, etc. Accordingly, rotors 120, 150 may each comprise, respectively, a polymer (e.g., a plastic), a metal, or any other suitable material. Of course, selected features or portions of rotors 120, 150 may comprise suitable, different materials. As shown in FIG. 6, rotor 120 includes a gear region 122, a hub region 126, and an ammunition cartridge conveying region 124. Similarly, rotor 150 includes a gear region 152, a hub region 156, and an ammunition cartridge conveying region 154. Further, each of rotors 120 and 150 may include a recess 119, 172, respectively, each recess 119, 172 configured for coupling to the housing cover 180, as described below. As shown in FIG. 7, each of hub regions 126 and 156 of rotors 120 and 150, respectively, includes an interlock feature 175. Interlock feature 175 of each of rotors 120 and 150, comprises a plurality of slots extending radially outwardly from a center region. More particularly, FIG. 8 shows a schematic view of interlock feature 175 including slots 160 extending radially outwardly from center region 162. As may be appreciated, end region 171 (FIGS. 6 and 7) of biasing element 170 (FIGS. 6 and 7) may be positioned within one of slots 160 of the interlock feature 175 of rotor 120. Such a configuration may allow for transmission of torque from the biasing element to the rotor 120, as discussed in greater detail below. FIG. 9 shows a perspective view of rotor 120, 150 depicting a plurality of concave depressions 168 generally aligned with central axis 111 of rotor 120, 150 and spaced generally about the circumference of rotor 120, 150. As shown in FIG. 9, longitudinally extending walls 166 may be positioned between circumferentially adjacent concave depressions 168. Optionally, longitudinally extending walls 166 may include a tapered region 164. In addition, gear teeth 158 are formed upon the gear region 152 of rotor 120, 150. FIG. 10 shows a side cross-sectional view of rotor 120, 150 including recess 172, interlock feature 175, bore 178, and recess 119. Further, a concave depression 168, a longitudinally extending wall 166 and tapered region 164 are also depicted in FIG. 10.

Figure 7:
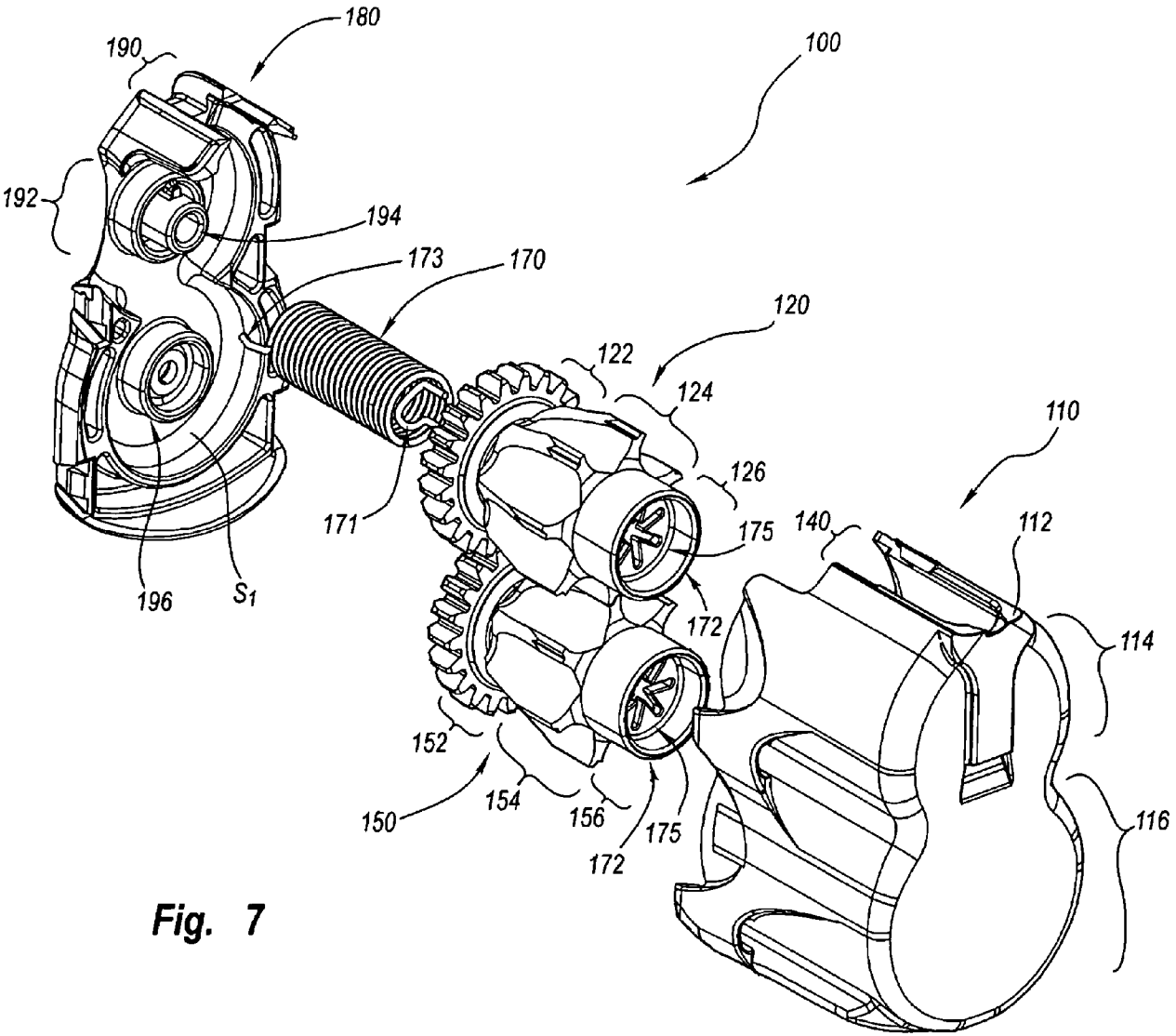
FIG. 7 shows an exploded assembly view of the magazine shown in FIG. 6 from a different vantage point.

As shown in FIGS. 6 and 7, rotors 120 and 150 may be substantially identical. However, variations of the above-described rotors are contemplated by the present invention. For example, rotors 120 and 150 may be sized differently or may be configured differently, if desired. Further, a rotor for use in a magazine according to the present invention may include concave depressions or may be otherwise configured for moving ammunition cartridges. For example, in one embodiment, a rotor may include generally radially extending paddles or fins extending from the rotor body to form cavities to move respective ammunition cartridges. Generally, any rotor suitably configured to move at least one ammunition cartridge along a serpentine path may be employed within a magazine according to the present invention. It should also be appreciated that while rotating elements (e.g., rotors and the like) may be utilized according to one embodiment of a magazine for moving an ammunition cartridge along a serpentine path, the present invention contemplates other embodiments of an ammunition cartridge magazine as well. For example, a magazine according to the present invention may comprise a serpentine recess (i.e., without rotors), wherein a movable element (e.g., a follower, as known in the art) is configured to move at least one ammunition cartridge along a serpentine path.

Figure 11:
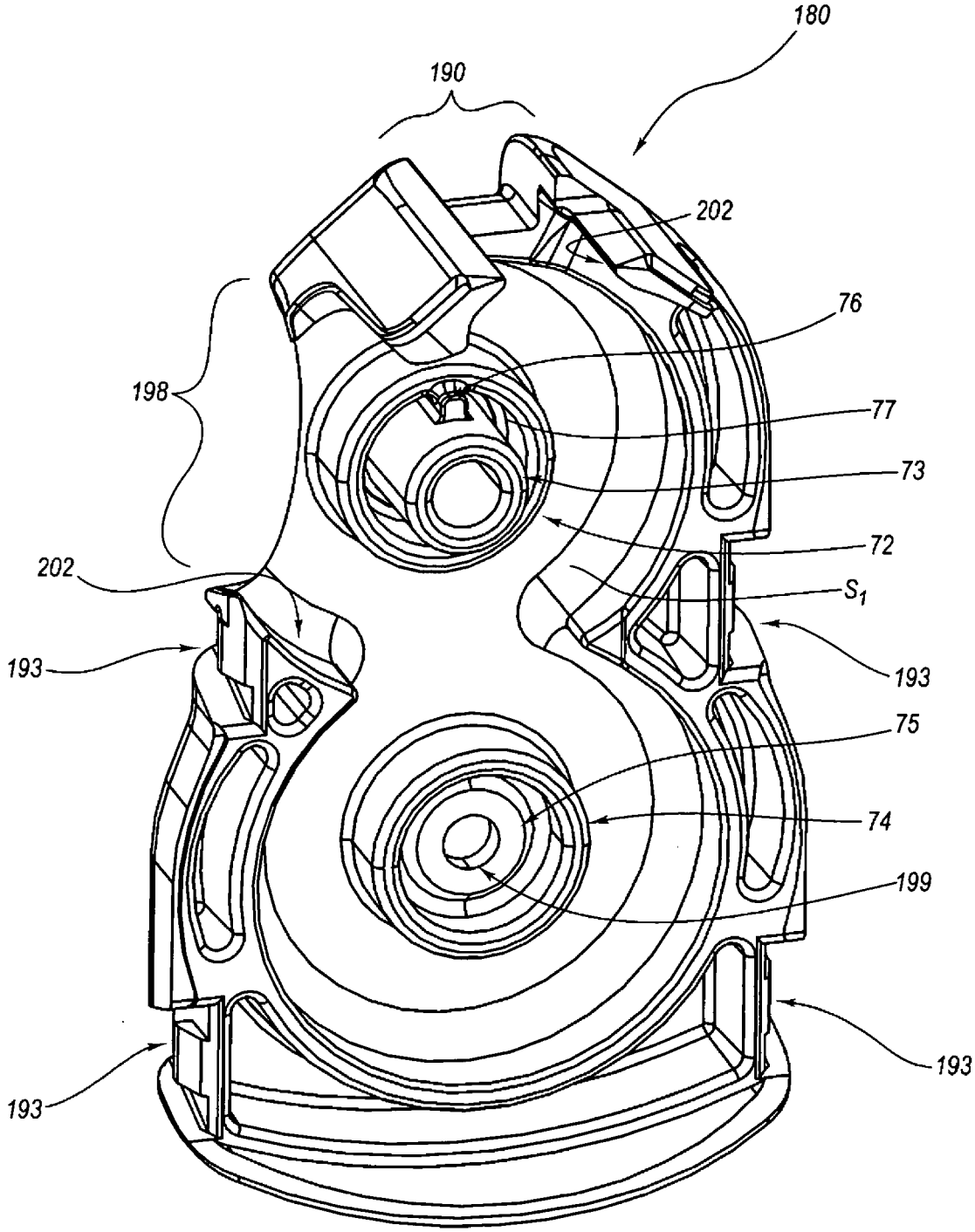
FIG. 11 shows a perspective view of the housing cover shown in FIGS. 6 and 7.

Turning to housing cover 180, FIG. 7 shows features of housing cover 180 including drive hub 194 and support hub 196. Drive hub 194 and support hub 196 may be configured to fit within recess 119 and recess 172 of rotors 120 and 150, respectively. Such a configuration may allow for rotation of rotors 120 and 150 about drive hub 194 and support hub 196, respectively. As shown in FIG. 7, housing cover 180 includes a surface $S_1$, which may be configured to define a boundary or an envelope that facilitates ejection or introduction of an ammunition cartridge from or into magazine 100, respectively. Thus, in general, surface $S_1$, may include features configured to facilitate movement of at least one ammunition cartridge along a serpentine path within magazine 100. In greater detail, FIG. 11 shows a perspective view of housing cover 180 including opening 190, gear access opening 198, and engagement features 193, as described above. In addition, surface $S_1$ includes guiding features 202 configured for facilitating movement of at least one ammunition cartridge along a serpentine path within magazine 100. Further, housing cover 180 includes an upper hub 72 surrounding an inner raised ring 73. Groove 77 is defined between the upper hub 72 and the inner raised ring 73 and may be configured for accepting at least a portion of end region 173 (FIGS. 6 and 7) of a biasing element. In addition, a stop feature 76 may be formed within groove 77 and may be configured to prevent rotation of a portion of the biasing element positioned within groove 77. Also, as shown in FIG. 11, lower hub 74 may surround a raised reinforcement region 75 through which aperture 199 is formed. As may be appreciated, upper hub 72 and lower hub 74 may be configured for fitting within recesses 172 of rotor 120 and rotor 150, respectively.

Figure 12:
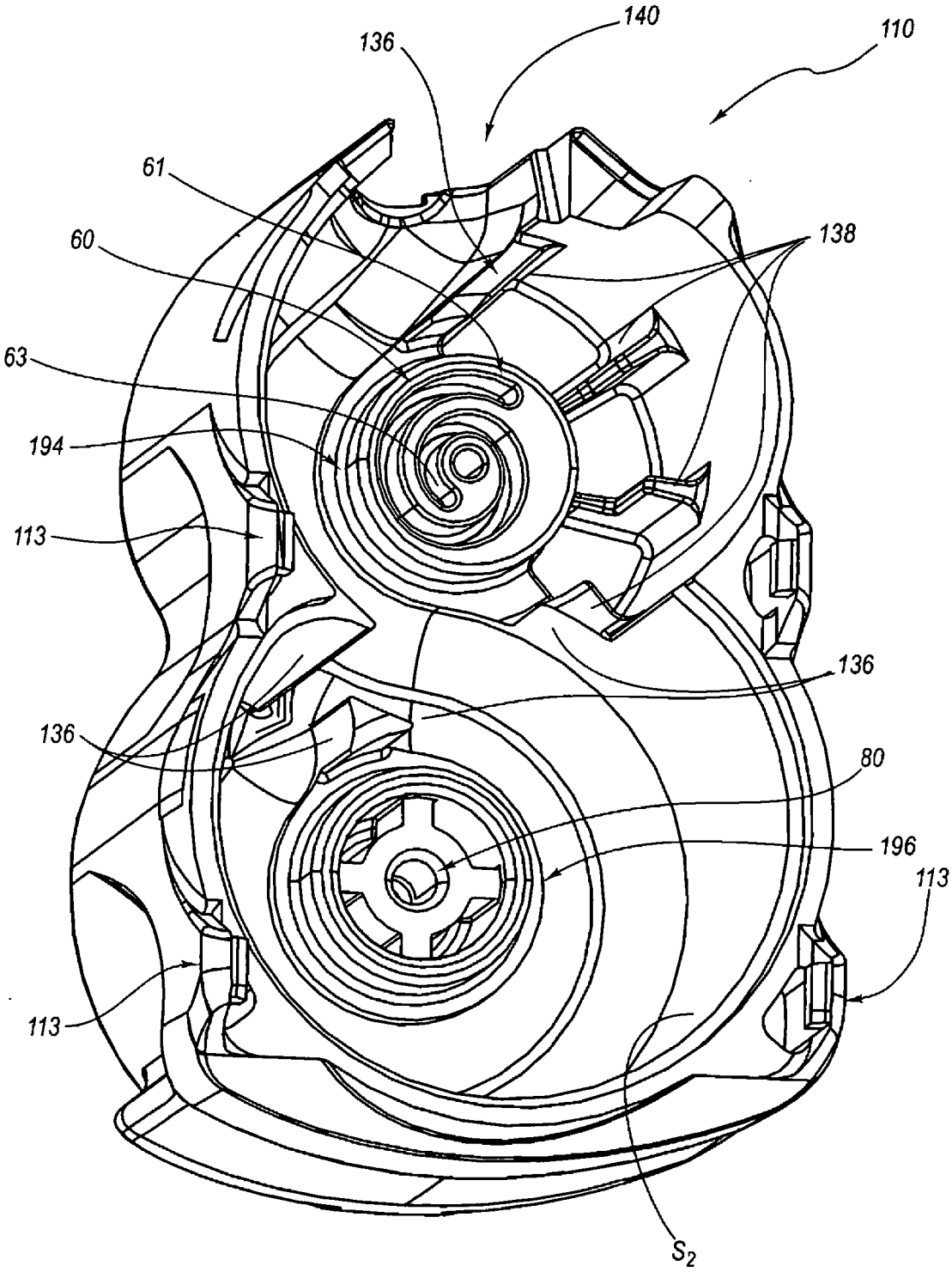
FIG. 12 shows a perspective view of the housing base shown in FIGS. 6 and 7.

Turning to housing base 110, FIG. 12 shows a perspective view of housing base 110 that shows additional aspects of housing base 110. Generally, as described above, cavity 109 of housing base 110 may be substantially defined by surface $S_2$. Further, $S_2$ also includes guiding features 136. Guiding features 136 may be configured to facilitate introduction of an ammunition cartridge into a magazine including housing base 110 or to facilitate introduction of an ammunition cartridge from such a magazine into a firearm. Guiding features 136 comprise surfaces that facilitate movement of at least one ammunition cartridge along at least a portion of a serpentine path within a magazine according to the present invention. Additionally, transverse walls 138 may be configured to prevent an ammunition cartridge from occupying the circumferential region about upper housing hub 194 within which the transverse walls 138 are formed. Thus, such a housing base 110 may be utilized to provide a magazine within which at least one ammunition cartridge moves along a serpentine path. Housing base 110 further includes a lower housing hub 196 generally surrounding a hole 80, which may be configured for allowing at least a portion of fastening element 200 to pass into the hole 80. As described above, fastening features 113 may be configured for coupling a cover to the open end of cavity 109. Each of housing base 110 and housing cover 180 may be respectively formed by any suitable processes known in the art, for example, injection molding, machining, etc. Accordingly, housing base 110 and housing cover may each comprise, respectively, a polymer (e.g., a plastic), a metal, or any other suitable material.

In addition, as shown in FIG. 12, housing base 110 includes an upper housing hub 194, which defines a spiral slot 60. The phrase "spiral slot" means any curve or arcuate path that, relative to a selected direction of rotation about a center, increases in radial position. Spiral slot 60 may be configured for defining or limiting a range of rotation of biasing rotor 120. Particularly, end region 171 (FIG. 6) of biasing element 170 may be positioned within spiral slot 60 so that the biasing element 170 is constrained to move within the spiral slot 60. Since biasing element 170 is coupled to rotor 120, such a configuration effectively defines or limits the relative amount of rotation that rotor 120 may attain. More specifically, end 63 of spiral slot 60 may correspond with a position of end region 171 (FIG. 6) of biasing element 170 when magazine 100 holds a maximum number of ammunition cartridges (i.e., fully loaded) therein and end 61 of spiral slot 60 may correspond with a position of the end region 171 (FIG. 6) of biasing element 170 when magazine 100 is unloaded.

Figure 14:
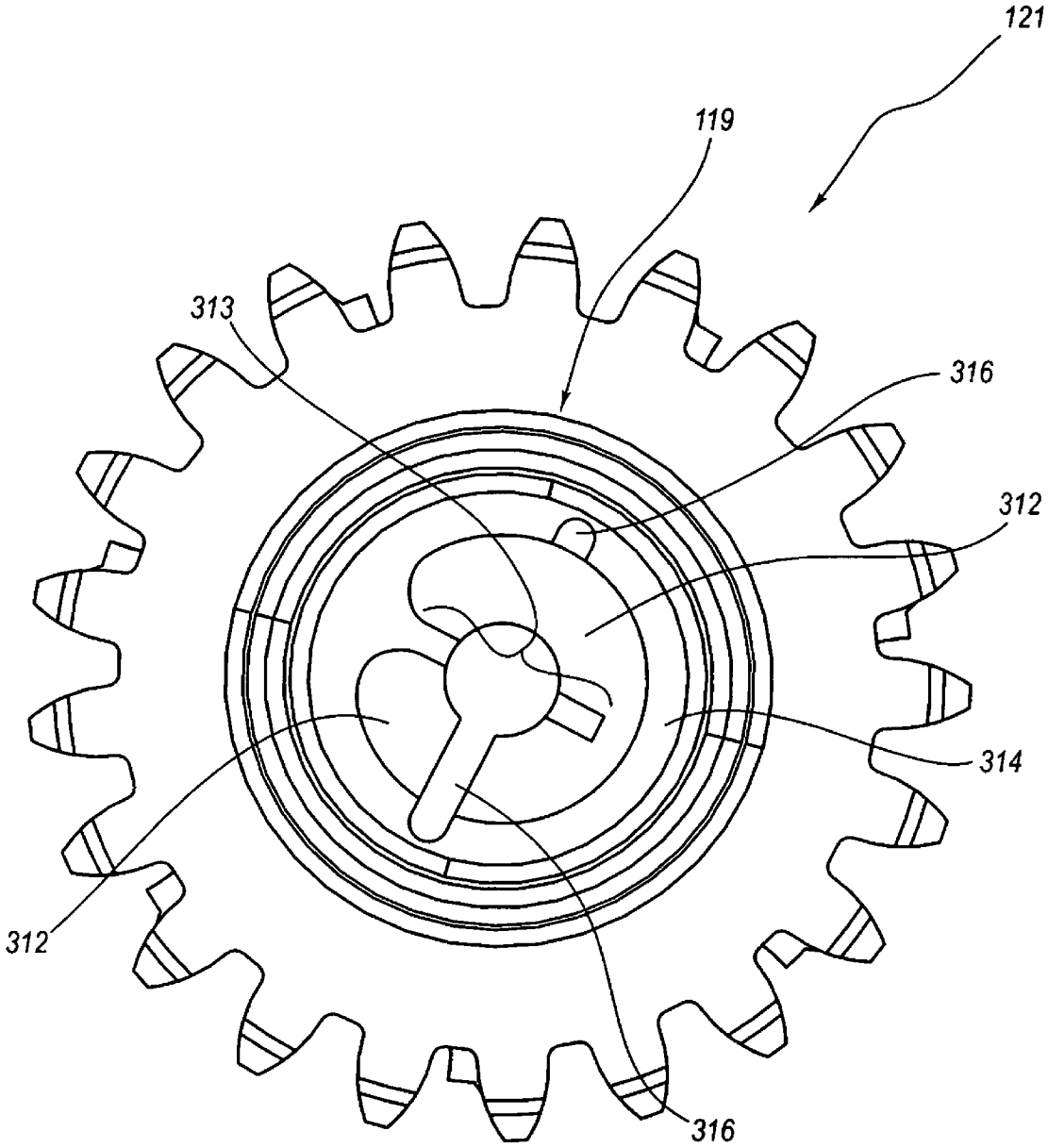
FIG. 14 shows an end view of a rotor shown in FIG. 13.

Also, it may be appreciated that biasing element 170 (FIGS. 6 and 7) may be constrained between end 61 of spiral slot 60 and stop feature 76 of housing cover 180 so that if a torque is applied to rotor 120 (e.g., by inserting an ammunition cartridge or via application of a torque to the portion of gear region 122 of rotor 120 exposed through housing cover 180), such a torque must exceed a selected minimum value to cause rotation of the rotor 120. Put another way, biasing element 170 may be preloaded between an end of spiral slot 60 and stop feature 76 of the housing cover 180 when the magazine 100 is completely unloaded. Preloading of biasing element 170 may be accomplished by placing at least a portion of end region 173 (FIG. 6) of biasing element 170 adjacent to stop feature 76 of housing cover 180, placing at least a portion of end region 171 (FIG. 6) of biasing element 170 through a slot 160 of interlock feature 175 of rotor 120 and rotating rotor 120 to generate a selected magnitude of torque within biasing element 170. Then, at least a portion of end region 171 (FIG. 6) of biasing element 170 may be positioned within spiral slot 60 (e.g., at end 61) so that a minimum selected magnitude of torque is exhibited by biasing element 170. Such a configuration may provide a sufficient magnitude of torque (when the portion of biasing element proximate the end 61 of spiral slot 60 to expel the last ammunition cartridge (e.g., ammunition cartridge 30 as shown in FIG. 14) from the magazine 100. Of course, as end region 171 (FIG. 6) of biasing element 170 moves within spiral slot 60 the magnitude of torque developed by biasing element 170 may increase over the minimum selected magnitude of torque, according to the behavior of the biasing element 170.

Figure 13:
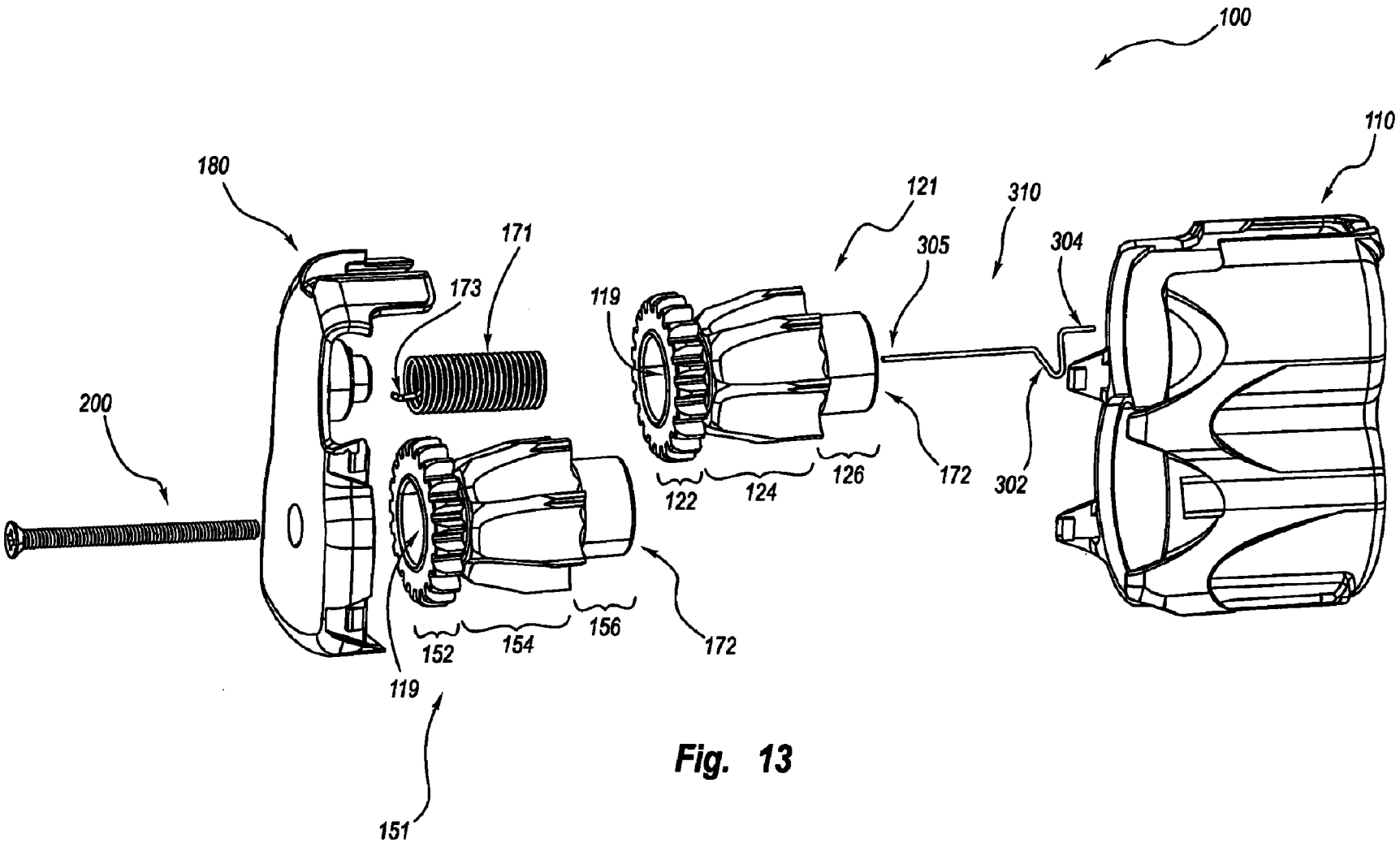
FIG. 13 shows an exploded, perspective view of another embodiment of a magazine.

In another embodiment, a rotation limiting element may be positioned between the biasing element and the spiral slot. Put another way, a biasing element may be positioned between a housing and a rotor and a rotation limiting element may be positioned between the rotor and the housing cover. For example, FIG. 13 shows an exploded perspective view of another embodiment of a magazine 100 including rotors 121, 151, housing 110, housing cover 180, biasing element 171, and rotation limiting element 310. Generally, rotor 121 includes a gear region 122, a hub region 126, and an ammunition cartridge conveying region 124 as described above relative to rotor 120. Similarly, rotor 151 includes a gear region 152, a hub region 156, and an ammunition cartridge conveying region 154 as described above relative to rotor 150.

Figure 15:
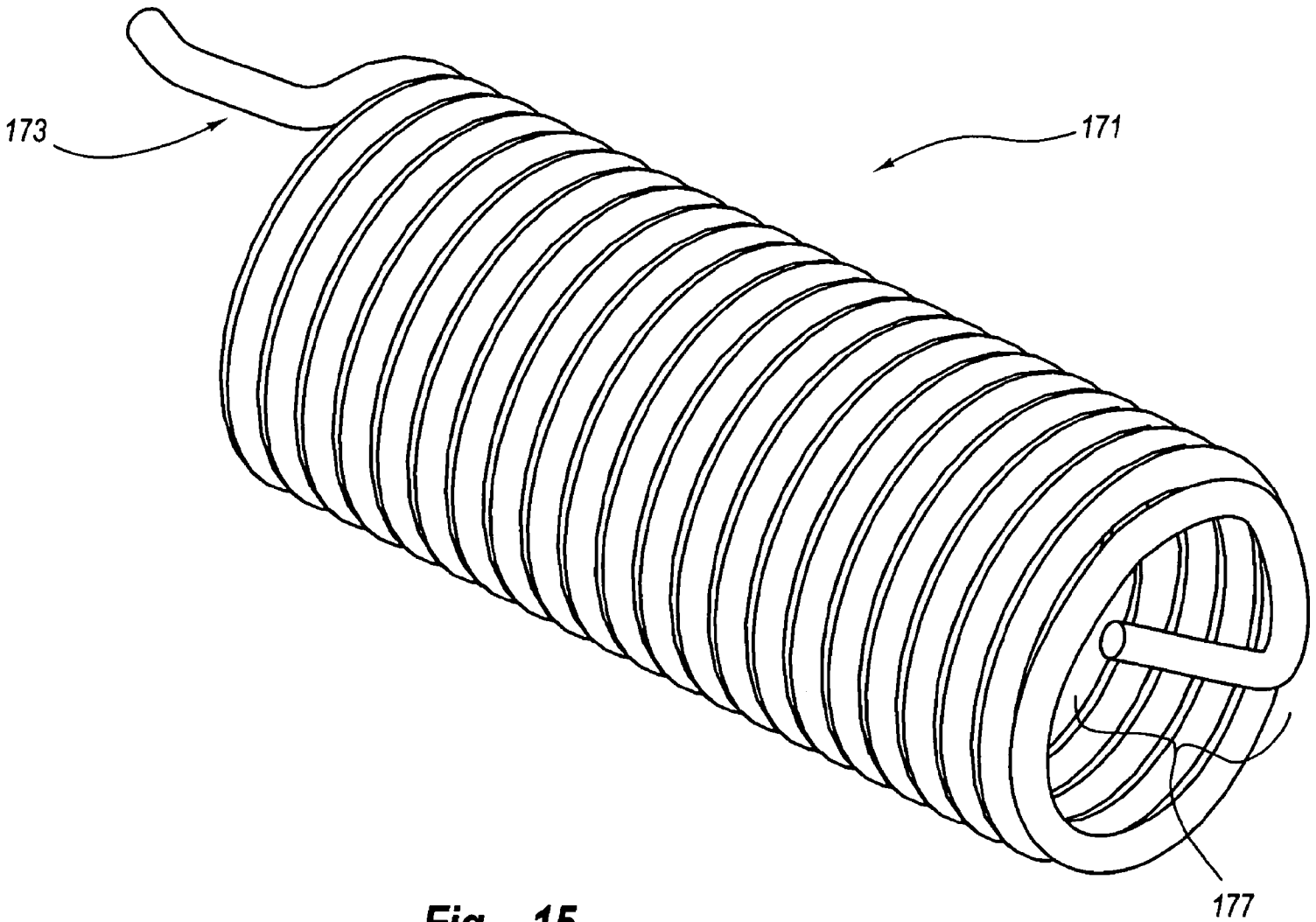
FIG. 15 shows a perspective view of a biasing element shown in FIG. 13.

Further, each of rotors 120 and 150 may include a recess 119, 172, respectively, each recess 119, 172 configured for coupling to the housing cover 180, as described above. As shown in FIG. 14 in an end view of rotor 121, rotor 121 (within recess 119) includes raised regions 312 defining, in combination with the interior of recess 119, a recessed region 314. As shown in FIG. 14, recessed region 314 includes a slot feature 313. Recessed region 314 and slot feature 313 may be structured for accepting at least a portion of biasing element 171 so that torque may be developed by the biasing element 171 in response to relative rotation of the rotor 121 in relation to stop feature 76 of housing cover 180 as described above. More particularly, FIG. 15 shows a perspective view of biasing element 171, which includes end region 173 and inwardly extending (with respect to an outer periphery or diameter of biasing element 171) end region 177. Thus, as may be appreciated, at least a portion of end region 177 may be positioned generally within slot feature 313 so that torque may be generated by biasing element 171 in response to rotation of rotor 121 relative to stop feature 76.

Figure 16:
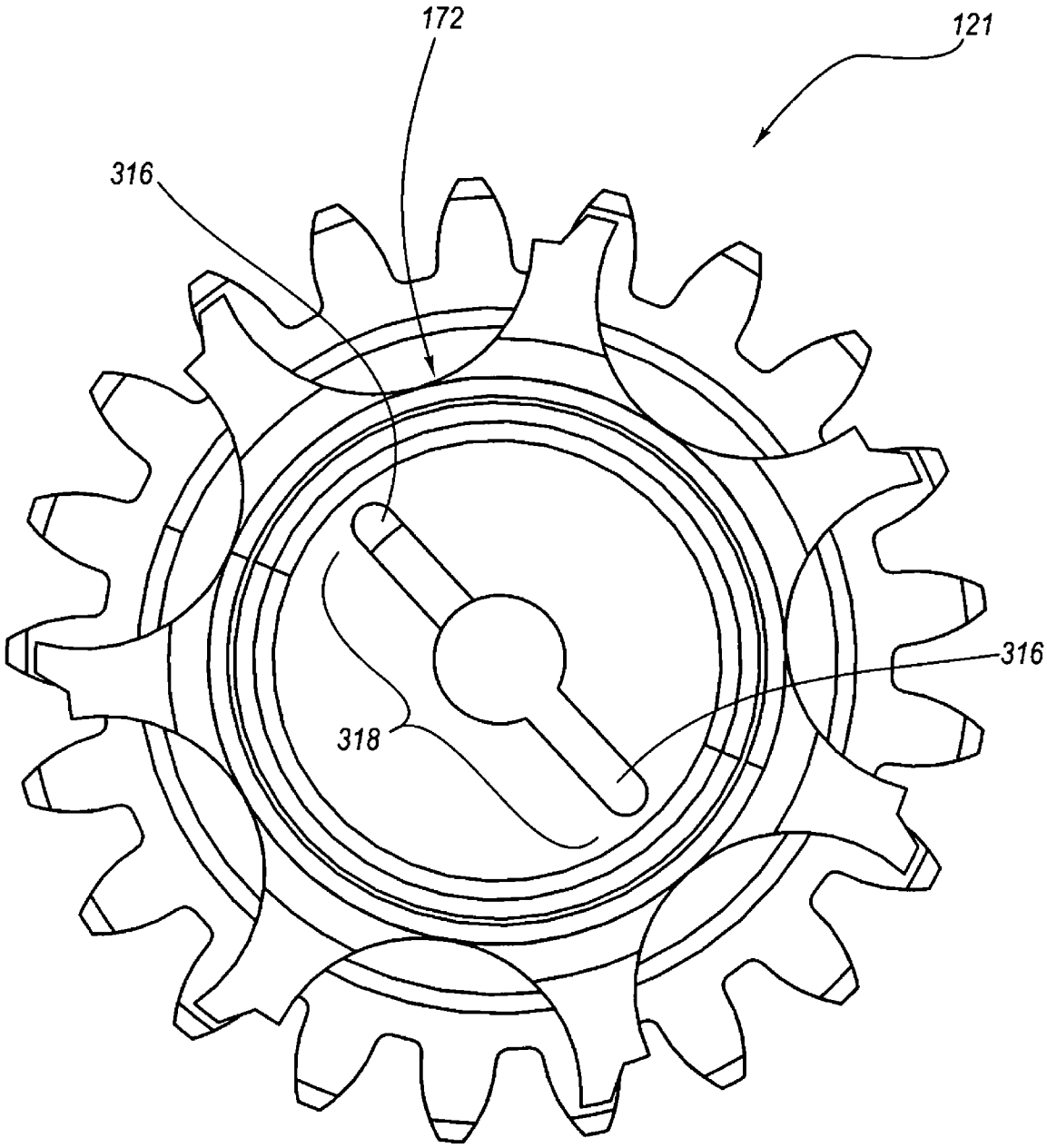
FIG. 16 shows another end view of the rotor shown in FIG. 14.

The present invention further contemplates that a rotation limiting element may be configured for allowing a selected amount of rotation of rotor 121. Such a configuration may limit the amount of stress developed within biasing element 171; thus, biasing element 171 may be protected from damage in response to an excessive amount of rotation of rotor 121. More particularly, in one embodiment, a portion of rotation limiting element 310 may extend through rotor 121. Optionally, rotation limiting element 310 may extend between drive hub 194 and spiral slot 60. Thus, as shown in FIG. 14, aperture 316 may be configured to accommodate at least a portion of rotation limiting element 310. Rotation limiting element 310 may also include a rotor coupling feature 302 which is configured for rotating with rotor 121, when rotor 121 rotates. More particularly, as shown in FIG. 16, which shows rotor 121 in an end view generally toward recess 172, a slot feature 318 may be formed within recess 172 of rotor 121 for accepting at least a portion of rotor coupling feature 302. Such a configuration may allow for transmission of torque from the biasing element to the rotor 121.

Figure 17:
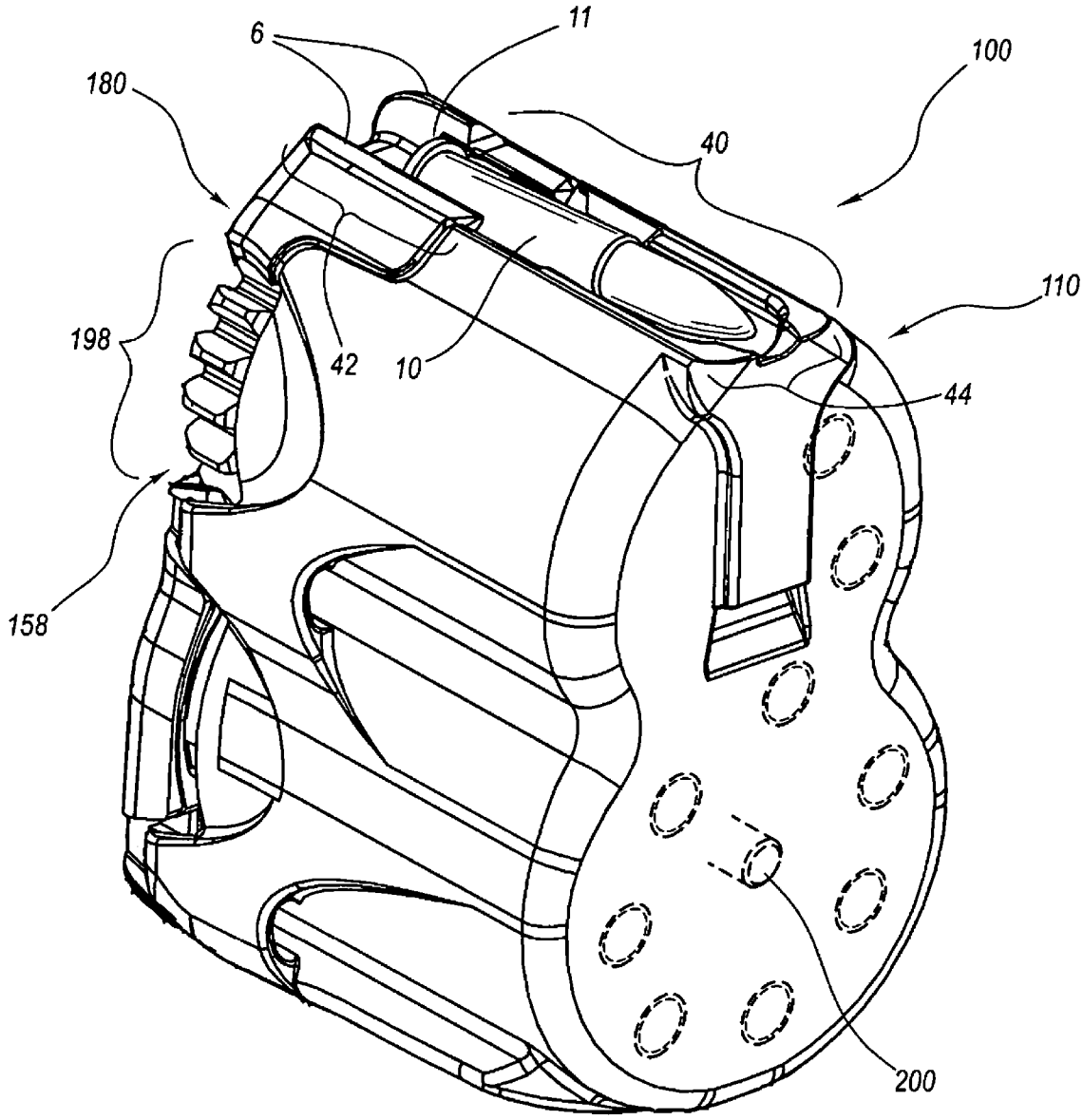
FIG. 17 shows a perspective view of an assembled magazine as shown in FIGS. 6 and 7, including an ammunition cartridge positioned generally within an ammunition cartridge feeding opening of the magazine.

Further, optionally, biasing element 171 may be preloaded by placing at least a portion of end region 173 (FIG. 6) of biasing element 170 adjacent to stop feature 76 of housing cover 180 and placing end region 304 of rotation limiting element 310 against end 61 of spiral slot 60 subsequent to generating a selected magnitude of torque within biasing element 171. Such a configuration may provide a sufficient magnitude of torque to expel the last ammunition cartridge (e.g., ammunition cartridge 30 as shown in FIG. 17) from the magazine 100. Of course, as end region 304 (FIG. 6) of rotation limiting element 310 moves within spiral slot 60 the magnitude of torque developed by biasing element 171 may increase over the minimum selected magnitude of torque, according to the behavior of the biasing element 171. It should be further appreciated that many various embodiments of a biasing system for biasing at least one rotor of a magazine within a selected rotation range.

FIG. 17 shows a perspective view of a magazine 100 including an ammunition cartridge 10 positioned generally within ammunition cartridge feeding opening 40. As shown in FIG. 17, gear access opening 198 formed in housing cover 180 allows for manipulation of gear teeth 158 of rotor 120 by a user. Further, fastening element 200 is positioned within aperture 199 and may effectively couple housing base 110 to housing cover 180. In addition, as known in the art, in one embodiment, ammunition cartridge feeding opening 40 may include a retaining region 42 that is configured to prevent ejection of ammunition cartridge 10 from magazine 100 because the opening formed within retaining region 42 is smaller than a cross-sectional size of rim 11 of ammunition cartridge 10. However, as known in the art, at least a portion of rim 11 may extend above upper surface 6 of retaining region 42 so that a bolt of a firearm may be moved from adjacent to rim 11 toward a forward end 44 of ammunition cartridge feeding opening 40 to remove ammunition cartridge 10 from magazine 100 and chamber ammunition cartridge 10 within the firearm.

Figure 18:
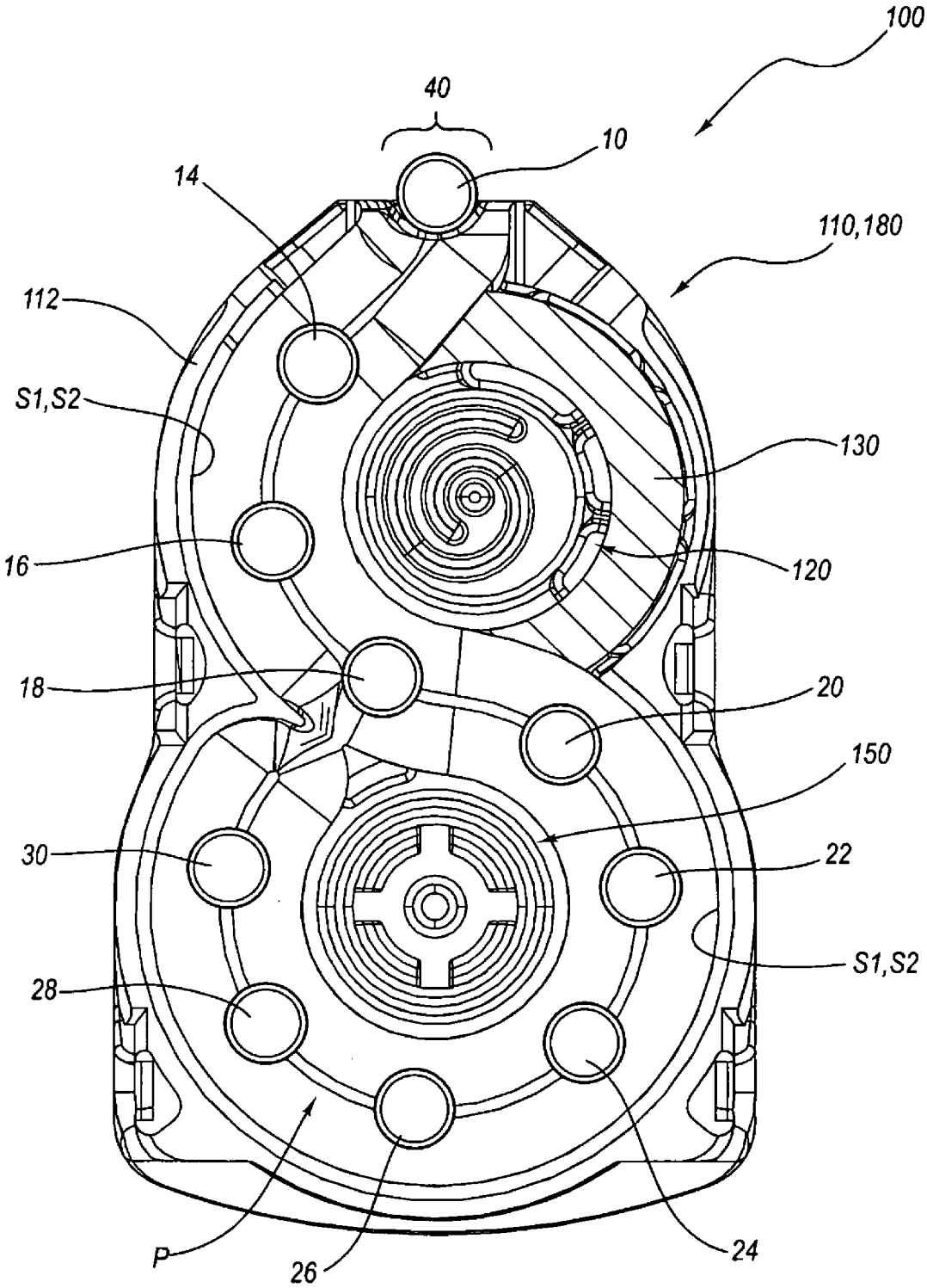
FIG. 18 shows a schematic view of the magazine as shown in FIG. 13.

FIG. 18 shows the schematic view of magazine 100, which contains ammunition cartridges 14, 16, 18, 20, 22, 24, 26, 28, and 30. Each of ammunition cartridges, 14, 16, 18, 20, 22, 24, 26, 28, and 30 may be positioned by rotors 120 and 150 (e.g., within a concave depression 168 formed between two circumferentially adjacent longitudinally extending walls 166) in combination with the interior surface features of surfaces $S_1$, $S_2$ of housing base 110 and housing cover 180, respectively. Thus, ammunition cartridges 14, 16, 18, 20, 22, 24, 26, 28, or 30 are precluded from occupying region 130. In addition, as shown in FIG. 18, ammunition cartridge 10 may be positioned generally within ammunition cartridge feeding opening 40. During use, ammunition cartridges 14, 16, 18, 20, 22, 24, 26, 28, and 30 may be introduced or fed into ammunition cartridge feeding opening 40 as each of the ammunition cartridges is moved from the ammunition cartridge feeding opening 40 and into a chamber of a firearm by the action of a bolt of the firearm. Accordingly, ammunition cartridges 20, 22, 24, 26, 28, and 30 are moved along a serpentine path prior to being positioned generally within ammunition cartridge feeding opening 40. As may be appreciated, each of rotors 120 and 150 (FIGS. 6 and 7) of magazine 100 may rotate at least about 1.5 times (i.e., 540°) to expel all of the ammunition cartridges of a fully loaded magazine 100 (as shown in FIG. 18). It may be advantageous for rotors to rotate between about 1 to 3 times (i.e., 360° to 1080°), because such a configuration may allow for ease in selection and may limit the stress and displacement of a biasing element (e.g., biasing element 170) configured for applying a torque to at least one of rotors 120 and 150.

In another embodiment, the present invention contemplates that ammunition cartridges may be positioned within region 130 and that rotors 120 and 150 may be configured so that the additional ammunition cartridges may be introduced into a firearm. For example, during operation of magazine 100, rotors 120 and 150 may be rotated independently (e.g., by decoupling or disengaging the gear regions 122 and 152 of rotors 120 and 150, respectively). In one embodiment, rotors 120 and 150 may be selectively engaged and disengaged. Explaining further, disengaging rotors 120 and 150 may provide ample space for the ammunition cartridges within region 130 to be fed from magazine 100 past rotor 150. In another embodiment, a portion of rotor 150 may be configured to allow for passage of ammunition cartridges positioned initially within region 130 by rotation of rotor 120. For example, at least one longitudinally extending wall 166 of rotor 150 may be pliant or may be movable so that an ammunition cartridge may pass between rotor 120 and 150 upon rotation of only rotor 120.

Figure 19:
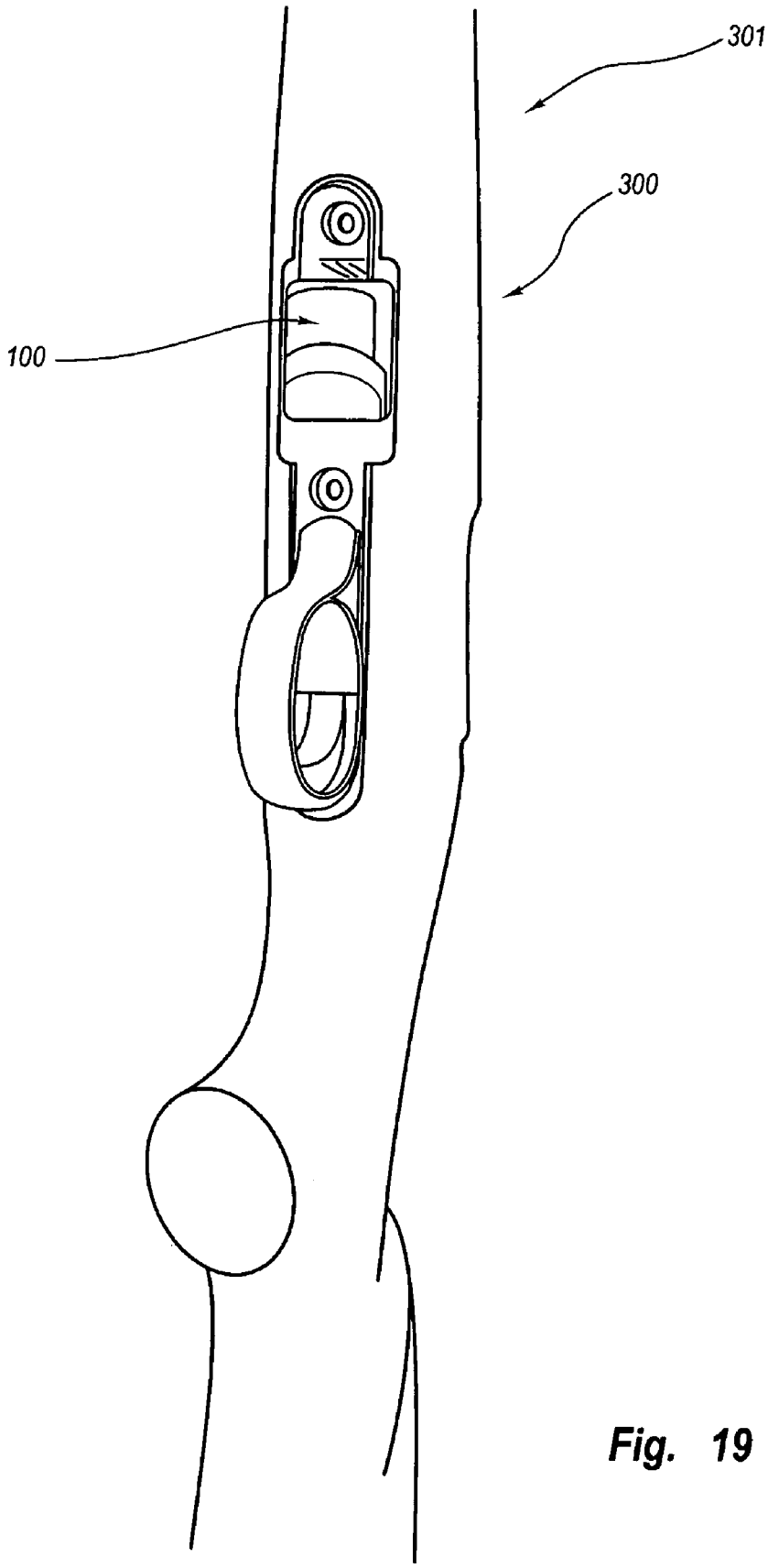
FIG. 19 shows a perspective view of a firearm system including a magazine according to the present invention operably coupled to a firearm.

As mentioned above, a magazine according to the present invention may be operably coupled to a firearm. More particularly, a magazine may be at least partially loaded with ammunition cartridges and operably coupled to a firearm to provide for sequential chambering of ammunition cartridges from the magazine to the chamber of the firearm. For example, FIG. 19 shows one embodiment of a firearm system 301 including magazine 100 operably coupled to a firearm 300. Of course, more generally, a magazine according to the present invention may be coupled to a firearm of any type (e.g., a pistol, a rifle, a shotgun, a flare gun, a paint-ball gun, etc.) as known in the art, without limitation. From the foregoing description, and referring to both FIGS. 18 and 19, it should be apparent that a magazine 100 including at least one ammunition cartridge may be assembled to the firearm 300.

In the case of a fully loaded magazine 100, as the firearm 300 is cocked the bolt is moved behind the first ammunition cartridge 10 positioned generally within ammunition cartridge feeding opening 40 of the magazine 100. As the bolt moves forward, the bolt strips the ammunition cartridge 10 from the ammunition cartridge feeding opening 40 and chambers the ammunition cartridge 10, as known in the art. As the ammunition cartridge 10 is stripped from the magazine 100, the rotors 120 and 150, under an applied torque generated by the biasing element 170, rotate (via interlocking gear regions 122 and 152 of rotors 120 and 15, respectively), to place the next ammunition cartridge 14 generally within ammunition cartridge feeding opening 40 of the magazine 100 and generally beneath the closed bolt of the firearm 300. Thus, when the firearm 300 is fired, the normal action of the bolt will feed the next ammunition cartridge (e.g., ammunition cartridges 14, 16, 18, 20, 22, 24, 26, 28, and 30) from the magazine 100, in succession, until the magazine 100 is emptied. It should be appreciated that the feeding mechanism for removing ammunition cartridges from a magazine and into a firearm may be configured according to any such mechanism as known in the art, without limitation.

While certain embodiments and details have been included herein and in the attached invention disclosure for purposes of illustrating the invention, it will be apparent to those skilled in the art that various changes in the methods and apparatus disclosed herein may be made without departing from the scope of the invention, which is defined in the appended claims.

What is claimed is:

1. A magazine for introducing a plurality of ammunition cartridges into a firearm comprising:

a first rotor configured for rotating about a first center of rotation in a first direction;

a second rotor configured for rotating about a second center of rotation in an opposite direction;

wherein a position of the first rotor and a position of the second rotor are fixed with respect to one another;

wherein the first rotor and the second rotor are configured so that any rotation of one of the first rotor or the second rotor causes rotation of the other one of the first rotor or the second rotor; and wherein operation of the first and second rotor causes at least one ammunition cartridge of a plurality of ammunition cartridges that are movable by the first and second rotor to move along a cartridge path that is defined by no more than two rotors, the entire cartridge path being a serpentine shaped path.

2. The magazine of claim 1, further comprising at least one biasing element configured for applying a torque to the first rotor.

3. The magazine of claim 1, further comprising a housing configured to facilitate movement of the at least one ammunition cartridge along the serpentine path.

4. The magazine of claim 3, wherein the housing comprises two components configured for assembly to one another.

5. The magazine of claim 4, further comprising a fastening element configured to couple the two components of the housing to one another.

6. The magazine of claim 2, wherein the at least one biasing element is preloaded.

7. The magazine of claim 6, further comprising a housing configured to facilitate movement of the at least one ammunition cartridge along the serpentine path, wherein the at least one biasing element is preloaded between a spiral slot formed in a first component of the housing and a stop feature formed in a second component of the housing.

8. The magazine of claim 2, wherein:

at least a portion of the at least one biasing element is positioned within a spiral slot formed within a housing configured to facilitate movement of the at least one ammunition cartridge along the serpentine path;

the spiral slot is configured to limit a magnitude of rotation attainable by the first rotor.

9. The magazine of claim 2, wherein:

at least a portion of a rotation limiting element is positioned within a spiral slot formed within a housing configured to facilitate movement of the at least one ammunition cartridge along the serpentine path;

the rotation limiting element is coupled to the first rotor to limit a range of rotation attainable by the first rotor.

10. The magazine of claim 2, wherein the first rotor and the second rotor are substantially identical.

11. The magazine of claim 10, wherein:

the first rotor includes a plurality of concave recesses spaced about a circumference of the first rotor, each of the plurality of concave recesses of the first rotor capable of accepting one ammunition cartridge of the plurality of ammunition cartridges;

the second rotor includes a plurality of concave recesses spaced about a circumference of the second rotor, each of the plurality of concave recesses of the second rotor capable of accepting one ammunition cartridge of the plurality of ammunition cartridges.

12. The magazine of claim 11, wherein the first rotor includes gear teeth and the second rotor includes gear teeth and the first rotor gear teeth are operably coupled to the second rotor gear teeth.

13. The magazine of claim 1, wherein the first and second rotor are each configured to rotate between about 360° and 1080° to expel the plurality of ammunition cartridges from the magazine.

14. The magazine of claim 1, wherein the first rotor and the second rotor are substantially identical.

15. The magazine of claim 14, wherein:

the first rotor includes a plurality of concave recesses spaced about a circumference of the first rotor, each of the plurality of concave recesses of the first rotor capable of accepting one ammunition cartridge of the plurality of ammunition cartridges;

the second rotor includes a plurality of concave recesses spaced about a circumference of the second rotor, each of the plurality of concave recesses of the second rotor capable of accepting one ammunition cartridge of the plurality of ammunition cartridges.

16. The magazine of claim 15, wherein the first rotor includes gears and the second rotor includes gears and the gears of the first rotor are operably coupled to the gears of the second rotor.

17. The magazine of claim 1, wherein one curve of the serpentine path extends generally from an ammunition cartridge feeding opening.

18. A firearm system comprising:

a firearm including a magazine operably coupled to the firearm for introducing a plurality of ammunition cartridges into the firearm;

wherein the magazine comprises:

a first rotor configured for rotating about a first center of rotation; and a second rotor configured for rotating about a second center of rotation;

wherein a position of the first rotor and a position of the second rotor are fixed with respect to one another;

wherein the first rotor and the second rotor are configured so that any rotation of one of the first rotor or the second rotor in a first direction causes rotation of the other one of the first rotor or the second rotor in an opposite direction; and wherein operation of the first and second rotor causes at least one ammunition cartridge of the plurality of ammunition cartridges positioned within the magazine to move along a cartridge path prior to introduction into the firearm, the entire cartridge path being defined by no more than two rotors, the cartridge path being a serpentine shaped path.

19. The firearm system of claim 18, wherein the firearm is selected from the group consisting of a pistol, a rifle, and a shotgun.

20. The firearm system of claim 18, further comprising at least one biasing element configured for applying a torque to the first rotor.

21. The firearm system of claim 18, further comprising a housing configured to facilitate movement of the at least one ammunition cartridge along the serpentine path.

22. The firearm system of claim 21, wherein the housing comprises two components configured for assembly to one another.

23. The firearm system of claim 22, further comprising a fastening element configured to couple the two components of the housing to one another.

24. The firearm system of claim 20, wherein the at least one biasing element is preloaded.

25. The firearm system of claim 24, further comprising a housing configured to facilitate movement of the at least one ammunition cartridge along the serpentine path, wherein the at least one biasing element is preloaded between a spiral slot formed in a first component of the housing and a stop feature formed in a second component of the housing.

26. The firearm system of claim 20, wherein the first rotor and the second rotor are substantially identical.

27. The firearm system of claim 26, wherein:

the first rotor includes a plurality of concave recesses spaced about a circumference of the first rotor, each of the plurality of concave recesses of the first rotor capable of accepting one ammunition cartridge of the plurality of ammunition cartridges;

the second rotor includes a plurality of concave recesses spaced about a circumference of the second rotor, each of the plurality of concave recesses of the second rotor capable of accepting one ammunition cartridge of the plurality of ammunition cartridges.

28. The firearm system of claim 27, wherein the first rotor includes gears and the second rotor includes gears and the gears of the first rotor are operably coupled to the gears of the second rotor.

29. The firearm system of claim 18, wherein the first and second rotor are each configured to rotate between about 360° and 1080° to expel the plurality of ammunition cartridges from the magazine.

30. The firearm system of claim 18, wherein the first rotor and the second rotor are substantially identical.

31. The firearm system of claim 30, wherein:

the first rotor includes a plurality of concave recesses spaced about a circumference of the first rotor, each of the plurality of concave recesses of the first rotor capable of accepting one ammunition cartridge of the plurality of ammunition cartridges;

the second rotor includes a plurality of concave recesses spaced about a circumference of the second rotor, each of the plurality of concave recesses of the second rotor capable of accepting one ammunition cartridge of the plurality of ammunition cartridges.

32. The firearm system of claim 31, wherein the first rotor includes gears and the second rotor includes gears and the gears of the first rotor are operably coupled to the gears of the second rotor.

33. The firearm system of claim 18, wherein one curve of the serpentine path extends generally from an ammunition cartridge feeding opening.

34. A firearm magazine comprising:

a first rotor that rotates on a first axis;

a second rotor that rotates on a second axis, the first rotor and the second rotor being positioned to move one or more ammunition cartridges through the firearm magazine;

a cartridge path that extends around only the first and second rotors, the entire cartridge path being a serpentine shaped path;

wherein the first rotor and the second rotor are configured so that any rotation of one of the first rotor or the second rotor in a first direction causes rotation of the other one of the first rotor or the second rotor in an opposite direction.

35. The firearm magazine of claim 34, wherein the first rotor and the second rotor are configured so that rotation of one of the first rotor or the second rotor in a clockwise direction causes rotation of the other one of the first rotor or the second rotor in a counter-clockwise direction.

36. The firearm magazine of claim 34, wherein the first rotor and the second rotor are positioned so that as the one or more ammunition cartridges move through the firearm magazine, the one or more ammunition cartridges move clockwise around one of the first axis or the second axis and move counter-clockwise around the other one of the first axis or the second axis.

37. The firearm magazine of claim 34, wherein the first axis and the second axis are not the same.

38. The firearm magazine of claim 34, wherein the first rotor and the second rotor are operably coupled together so that rotation of one of the first rotor or the second rotor causes rotation of the other one of the first rotor or the second rotor.

39. The firearm magazine of claim 34, wherein one of the first rotor or the second rotor includes a gear that cooperates with the other one of the first rotor or the second rotor so that rotation of one of the first rotor or the second rotor causes rotation of the other one of the first rotor or the second rotor.

40. The firearm magazine of claim 34, comprising at least one biasing element configured to apply a torque to at least one of the first rotor or the second rotor.

41. A firearm magazine comprising:

a first rotor configured to rotate about a first center of rotation in a first direction;

a second rotor configured to rotate about a second center of rotation in an opposite direction;

wherein a position of the first rotor and a position of the second rotor are fixed with respect to one another;

wherein operation of the first rotor and the second rotor moves at least one ammunition cartridge along a cartridge path that extends around at least a portion of each of the first rotor and the second rotor and is defined by no more than two rotors, the entire cartridge path being a serpentine shaped path.

42. The firearm magazine of claim 41, wherein the first rotor and the second rotor are configured so that rotation of one of the first rotor or the second rotor in a clockwise direction causes rotation of the other one of the first rotor or the second rotor in a counter-clockwise direction.

43. The firearm magazine of claim 41, wherein the first rotor and the second rotor move the at least one ammunition cartridge clockwise around one of the first center of rotation or the second center of rotation and counter-clockwise around the other one of the first center of rotation or the second center of rotation.

44. The firearm magazine of claim 41, wherein the first center or rotation and the second center of rotation are not the same.

45. The firearm magazine of claim 41, wherein one of the first rotor or the second rotor includes a gear that cooperates with the other one of the first rotor or the second rotor so that rotation of one of the first rotor or the second rotor causes rotation of the other one of the first rotor or the second rotor.

46. The firearm magazine of claim 34, comprising at least one biasing element configured to apply a torque to at least one of the first rotor or the second rotor.

47. A magazine for introducing a plurality of ammunition cartridges into a firearm comprising:

a first rotor configured for rotating about a first center of rotation;

a second rotor configured for rotating about a second center of rotation;

at least one biasing element configured for applying a torque to the first rotor;

wherein a position of the first rotor and a position of the second rotor are fixed with respect to one another;

wherein the first rotor and the second rotor are configured so that any rotation of one of the first rotor or the second rotor causes rotation of the other one of the first rotor or the second rotor;

wherein operation of the first and second rotor causes at least one ammunition cartridge of a plurality of ammunition cartridges that are movable by the first and second rotor to move along a serpentine path;

a housing configured to facilitate movement of the at least one ammunition cartridge along the serpentine path, wherein the at least one biasing element is preloaded between a spiral slot formed in a first component of the housing and a stop feature formed in a second component of the housing.

48. The magazine of claim 47, wherein the housing comprises two components configured for assembly to one another.

49. The magazine of claim 47, wherein the first rotor and the second rotor are substantially identical.

50. The magazine of claim 47, wherein:

the first rotor includes a plurality of concave recesses spaced about a circumference of the first rotor, each of the plurality of concave recesses of the first rotor capable of accepting one ammunition cartridge of the plurality of ammunition cartridges;

the second rotor includes a plurality of concave recesses spaced about a circumference of the second rotor, each of the plurality of concave recesses of the second rotor capable of accepting one ammunition cartridge of the plurality of ammunition cartridges.

51. The magazine of claim 47, wherein the first rotor includes gear teeth and the second rotor includes gear teeth and the first rotor gear teeth are operably coupled to the second rotor gear teeth.

52. A magazine for introducing a plurality of ammunition cartridges into a firearm comprising:

a first rotor configured for rotating about a first center of rotation;

a second rotor configured for rotating about a second center of rotation;

at least one biasing element configured for applying a torque to the first rotor;

wherein a position of the first rotor and a position of the second rotor are fixed with respect to one another;

wherein the first rotor and the second rotor are configured so that any rotation of one of the first rotor or the second rotor causes rotation of the other one of the first rotor or the second rotor;

wherein operation of the first and second rotor causes at least one ammunition cartridge of a plurality of ammunition cartridges that are movable by the first and second rotor to move along a serpentine path;

at least a portion of the at least one biasing element is positioned within a spiral slot formed within a housing configured to facilitate movement of the at least one ammunition cartridge along the serpentine path;

the spiral slot is configured to limit a magnitude of rotation attainable by the first rotor.

53. A firearm system comprising:

a firearm including a magazine operably coupled to the firearm for introducing a plurality of ammunition cartridges into the firearm;

wherein the magazine comprises:

a first rotor configured for rotating about a first center of rotation; and a second rotor configured for rotating about a second center of rotation;

at least one biasing element configured for applying a torque to the first rotor, the at least one biasing element is preloaded;

a housing;

wherein a position of the first rotor and a position of the second rotor are fixed with respect to one another;

wherein the first rotor and the second rotor are configured so that any rotation of one of the first rotor or the second rotor causes rotation of the other one of the first rotor or the second rotor; and wherein operation of the first and second rotor causes at least one ammunition cartridge of the plurality of ammunition cartridges positioned within the magazine to move along a serpentine path prior to introduction into the firearm, the serpentine path being defined by no more than two rotors;

wherein the housing is configured to facilitate movement of the at least one ammunition cartridge along the serpentine path;

wherein the at least one biasing element is preloaded between a spiral slot formed in a first component of the housing and a stop feature formed in a second component of the housing.

* * * * *